US005520330A

United States Patent [19]

Brown et al.

[11] Patent Number: 5,520,330

[45] Date of Patent: May 28, 1996

[54] RAILWAY RAIL-FASTENING CLIP AND ASSEMBLY AND METHODS OF EMPLOYING THE SAME

[75] Inventors: Trevor P. Brown, Orpington; Brian G. Conroy, Worksop; Stephen J. Cox, Richmond; Christopher Gardner, Sheffield; Roger D. Larke, Retford; Barry Marshall, Sheffield, all of United Kingdom; Jan Svendsen, Tranby, Norway

[73] Assignee: Pandrol Limited, Surry, United Kingdom

[21] Appl. No.: 244,717

[22] PCT Filed: Dec. 18, 1992

[86] PCT No.: PCT/GB92/02359

§ 371 Date: Aug. 11, 1994

§ 102(e) Date: Aug. 11, 1994

[87] PCT Pub. No.: W093/12296

PCT Pub. Date: Jun. 24, 1994

[30] Foreign Application Priority Data

Mar. 17, 1992 [GB] United Kingdom ..... 9205791
Dec. 18, 1992 [GB] United Kingdom ..... 9126886

[51] Int. Cl.[6] ..... E01B 9/00

[52] U.S. Cl. ..... 238/351; 238/343

[58] Field of Search ..... 238/349, 351, 238/310, 315, 343

[56] References Cited

U.S. PATENT DOCUMENTS

| | | | |
|---|---|---|---|
| 2,162,365 | 6/1939 | Willard | 238/349 |
| 2,570,871 | 10/1951 | Schulze | 238/351 |
| 3,428,253 | 2/1969 | Meier | 238/349 |
| 3,439,874 | 10/1969 | Meier | 238/349 |
| 3,696,998 | 10/1972 | Bhasaran Nair | 238/349 |
| 3,724,754 | 4/1973 | Molyneux et al. | 238/349 |
| 3,876,141 | 4/1975 | French | 238/349 |
| 4,349,150 | 9/1982 | Lubbers | 238/265 |
| 4,632,308 | 12/1986 | Fischer | 238/265 |
| 4,802,623 | 2/1989 | Fasterding et al. | 238/349 |
| 4,844,337 | 7/1989 | Fee | 238/349 |

FOREIGN PATENT DOCUMENTS

| | | |
|---|---|---|
| 0024774 | 3/1981 | European Pat. Off. . |
| 0027838 | 5/1981 | European Pat. Off. . |
| 0027839 | 5/1981 | European Pat. Off. . |
| 0156349 | 10/1985 | European Pat. Off. . |
| 0295685 | 12/1988 | European Pat. Off. . |
| 0401424 | 12/1990 | European Pat. Off. . |
| 2436848 | 4/1980 | France . |
| 1253297 | 10/1963 | Germany . |
| 1061810 | 12/1969 | Germany . |
| 1534074 | 12/1970 | Germany . |
| 3003867 | 9/1981 | Germany . |
| 311187 | 6/1982 | Germany . |
| 8804426 | 5/1988 | Germany . |
| 8906790 | 8/1989 | Germany . |
| 128477 | 9/1972 | Poland . |
| 513292 | 9/1971 | Switzerland . |
| 1271186 | 4/1972 | United Kingdom . |
| 2070110 | 10/1979 | United Kingdom . |
| 1553793 | 10/1979 | United Kingdom . |
| 2085057 | 9/1980 | United Kingdom . |
| 2075580 | 11/1981 | United Kingdom . |
| 2106571 | 4/1983 | United Kingdom . |

(List continued on next page.)

*Primary Examiner*—Mark T. Le
*Attorney, Agent, or Firm*—Depaoli & Frenkel

[57] ABSTRACT

A railway rail fastening clip (1) suitable for holding down a railway rail (2) is formed from a rod of resilient material bent so as to be approximately M-shaped in plan, the clip (1) being such that, when it is bearing on the flange of a rail (2), the longitudinal axis of a part (14) thereof, which interconnects inner legs (13, 15) of the M, lies in a reference plane which is substantially parallel, but not identical, to a plane containing the longitudinal axes of outer legs (11, 17) of the M. Such clips (1) are used with an anchoring device (5), which, as the clip (1) is installed therein, deflects the outer legs (11, 17) downwardly with respect to the inner legs (13, 15), so as to place the clip under stress.

27 Claims, 15 Drawing Sheets

FOREIGN PATENT DOCUMENTS

| | | |
|---|---|---|
| 2153416 | 8/1985 | United Kingdom . |
| W081/00121 | 1/1981 | WIPO . |
| W08100121 | 1/1981 | WIPO . |
| W082/00669 | 3/1982 | WIPO . |
| W08200669 | 3/1982 | WIPO . |
| W084/04766 | 12/1984 | WIPO . |
| W08404766 | 12/1984 | WIPO . |
| W08700566 | 1/1987 | WIPO . |
| W087/00566 | 1/1987 | WIPO . |
| W09015192 | 12/1990 | WIPO . |
| W090/15192 | 12/1990 | WIPO . |
| W09100391 | 1/1991 | WIPO . |
| W09111556 | 8/1991 | WIPO . |
| W091/11556 | 8/1991 | WIPO . |

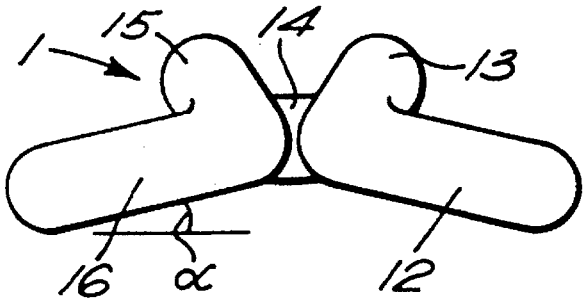
FIG. 2C.
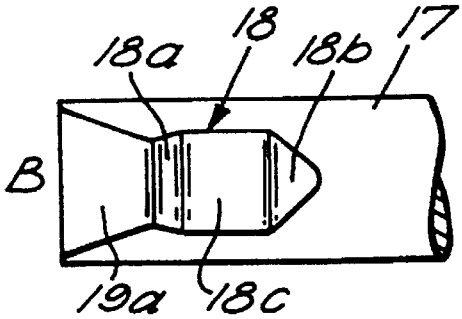
FIG. 2D.
FIG. 2E.
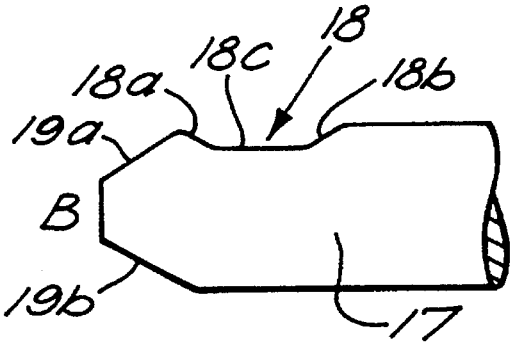
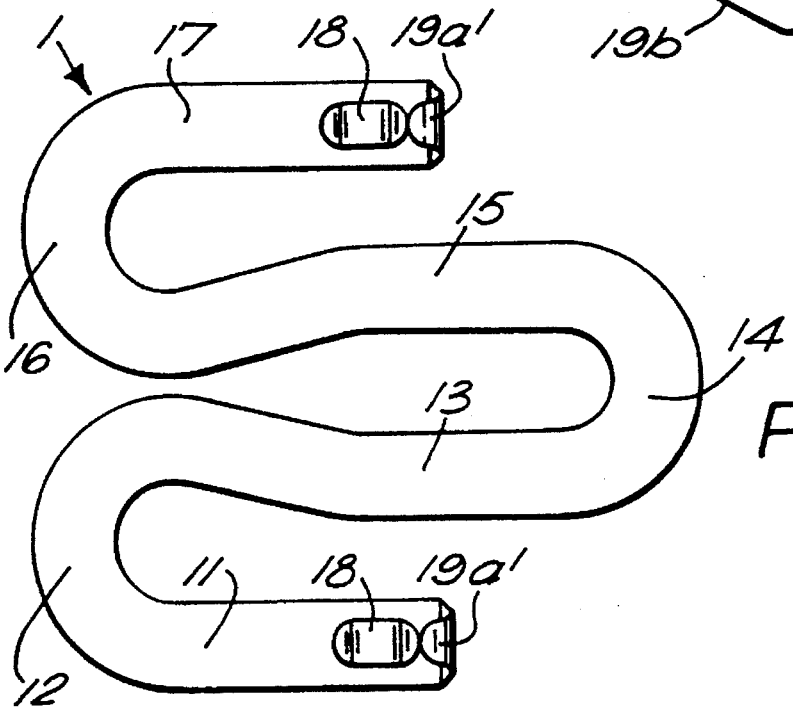
FIG. 3A.

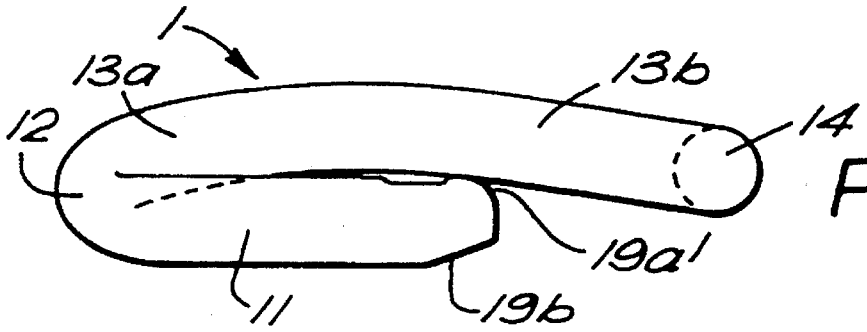
FIG.3B.
FIG.3C.
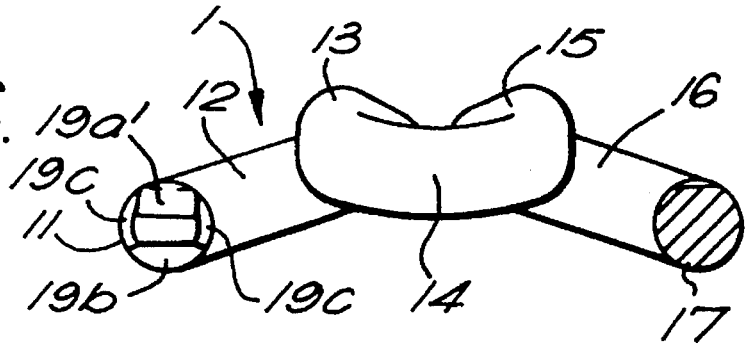
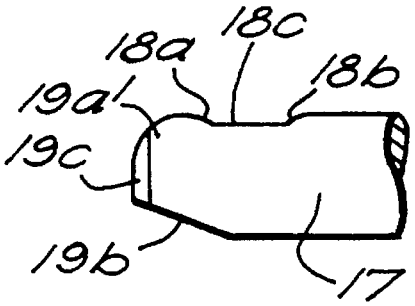
FIG.3D.
FIG.3E.
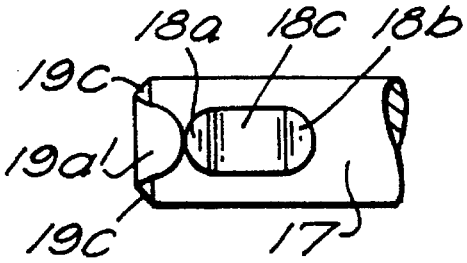

FIG.9A.
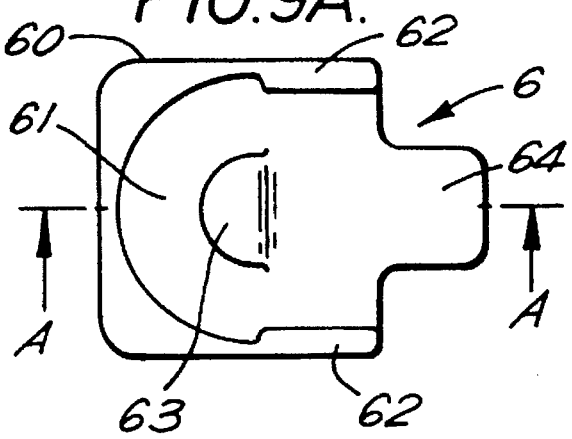
FIG.9B.
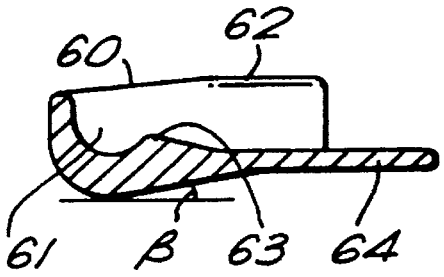
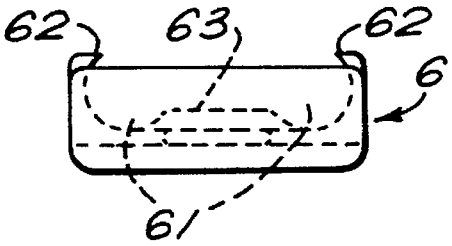
FIG.9C.
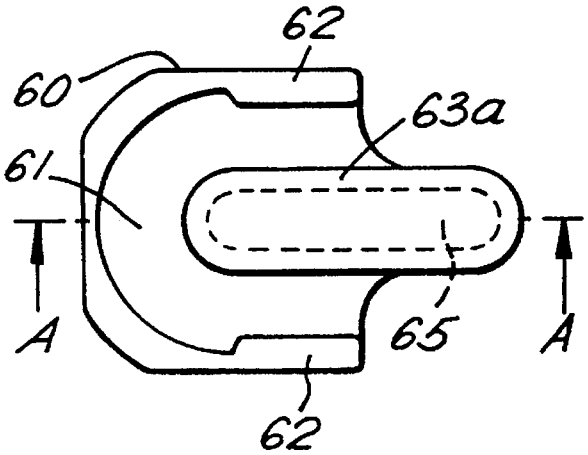
FIG.10A.
FIG.10B.
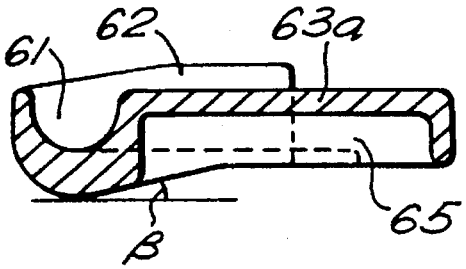
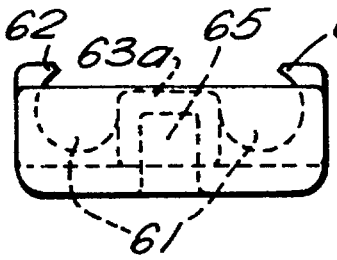
FIG.10C.

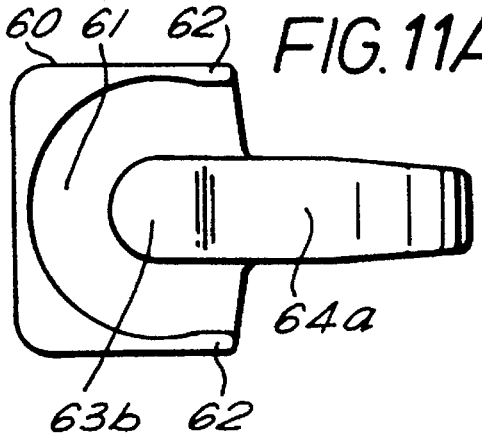
FIG.11A.
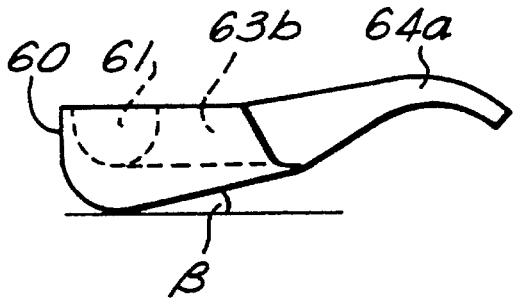
FIG.11B.
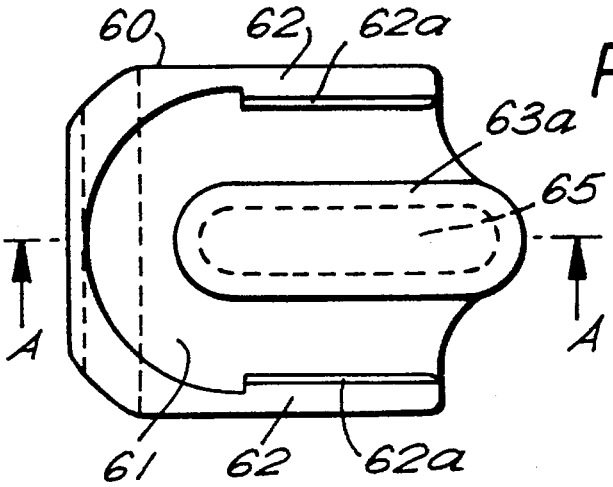
FIG.12A.
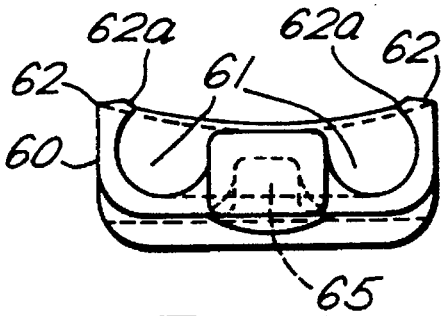
FIG.12C.
FIG.12B.
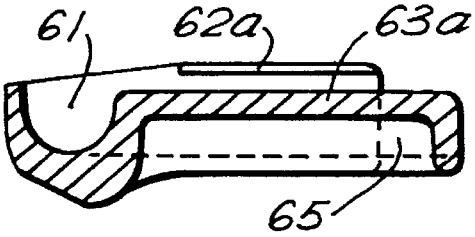

RAILWAY RAIL-FASTENING CLIP AND ASSEMBLY AND METHODS OF EMPLOYING THE SAME

BACKGROUND OF THE INVENTION

The present invention relates to a railway rail-fastening clip and assembly and methods of employing the same.

The applicant's previous inventions, rail clips commonly referred to respectively as a "P-R" clip (disclosed in GB-861,473) and an "e"-clip (disclosed in GB-1,510,224), have both been successful for many years, providing low-cost rail fastenings that have been widely used in many countries around the world. These clips may be installed into shoulders alongside the rail either manually, using a sledge-hammer to drive the clip into the shoulder, or automatically by a clip driving machine. Whilst automatic clip installation is obviously more desirable, being quicker and less labour-intensive, it can be a fairly complex process, requiring accurate positioning of the clip relative to the shoulder in order to achieve an adequate rail fastening.

SUMMARY OF THE INVENTION

According to a first aspect of the present invention there is provided a railway rail fastening clip suitable for holding down a railway rail, which clip is formed from a rod of resilient material bent so as to be approximately M-shaped in plan, the clip having, proceeding from one end of the rod to the other, a substantially straight first portion, a bent second portion, a third portion, a bent fourth portion, a fifth portion, a bent sixth portion, and a substantially straight seventh portion, the first and seventh portions forming respectively the outer legs of the M, the third and fifth portions forming respectively the inner legs of the M, the second and sixth portions joining the outer legs to the inner legs and the fourth portion connecting the inner legs together, wherein, when the clip is bearing on a rail, the longitudinal axis of the fourth portion lies in a plane which is substantially parallel, but not identical, to a plane containing the longitudinal axes of the first and seventh portions.

Preferably, when a clip embodying the first aspect of the present invention is free from stress, no part of the longitudinal axes of the second and sixth portions of the clip is inclined with respect to the plane containing the longitudinal axes of the first and seventh portions by an angle greater than 40° or, even more desirably, by an angle greater than 35°.

Alternatively, or additionally, when a clip embodying the first aspect of the present invention is free from stress, the ratio of the maximum distance between the longitudinal axis of each inner leg and the plane containing the longitudinal axes of the first and seventh portions to the diameter of the rod forming the clip is equal to or less than 4, and is preferably less than or equal to 2.0, and is most desirably less than or equal to 1.25.

Preferably, in a clip embodying the first aspect of the present invention, the longitudinal axes of the said first and seventh portions are substantially parallel to one another.

Desirably, in a clip embodying the first aspect of the present invention, the said third and fifth portions are substantially curved such that their longitudinal axes lie in respective planes which are at least approximately perpendicular to the said plane containing the axes of said first and seventh portions of the clip.

Preferably, in a clip embodying the first aspect of the present invention, the said third and fifth portions are spaced apart from one another by the said fourth portion and the said second and sixth portions are bent such that respective parts thereof are closely adjacent to one another.

Desirably, when a clip embodying the first aspect of the present invention is viewed in plan, the said fourth portion extends beyond respective free ends of the first and seventh portions.

Preferably, in a clip embodying the first aspect of the present invention, the surface of each outer leg, adjacent to a free end of the rod, is, at least at the part which is uppermost when the clip is in use, inclined downwardly with respect to the longitudinal axis of the outer leg proceeding along that outer leg towards the free end, desirably at an angle of 30°.

Desirably, in a clip embodying the first aspect of the present invention, at least one of the inner or outer legs of the clip is provided with first locating means for cooperating with second locating means provided on a clip anchoring device so as to locate the said clip at a desired position with respect to the said clip anchoring device when installed therein, wherein at least one abutment surface forms one of the first and second locating means and at least one cooperating projection forms the other of the first and second locating means, both the abutment surface and one face of the cooperating projection being acutely inclined in one sense to the longitudinal axis of the leg of the clip having said first locating means thereon such that the said one face of the said cooperating projection abuts against the said abutment surface so as to locate the clip, but such that driving of the clip in either of two directions parallel to the said axis forces said projection out of contact with said abutment surface. Preferably, the or each leg provided with said first locating means is one of the outer legs of the clip. Respective such first locating means are desirably provided on each of the said outer legs for cooperating with corresponding second locating means provided on the said anchoring device, when the clip is installed therein.

Preferably, in such a clip, the or each abutment surface is formed by one inclined face of a recess, another face of the said recess being acutely inclined in the opposite sense to said longitudinal axis, said recess preferably being formed in a part of the or each outer leg which is uppermost when the clip is in use, which is desirably near the free end of that leg. Desirably, the inclined faces of said recess are joined together by a further face of the said recess which is substantially parallel to the longitudinal axis of the outer leg of the clip, such that said inclined faces are spaced apart from one another by a predetermined distance, thereby defining two desired positions at which said clip may be located with respect to the anchoring device when installed therein.

According to a second aspect of the present invention there is provided an anchoring device, for retaining a railway rail fastening clip, which device has a base member and a pair of clip-retaining members connected to said base member and extending substantially upwardly with respect thereto when the device is in use, said clip-retaining members being spaced apart so as to define an opening therebetween for receiving the interconnected inner legs of such an M-shaped clip and being formed with respective guiding passageways therethrough for receiving respectively the outer legs of the M-shaped clip, the device being such that, as a clip is driven into it, the outer legs thereof are forced downwardly with respect to the inner legs, thereby placing the clip under stress.

Preferably, in an anchoring device embodying the second aspect of the present invention, the said guiding passageways are formed on respective outer faces of the said clip-retaining members.

Desirably, in an anchoring device embodying the second aspect of the present invention, each of the said guiding passageways is in the form of a channel formed in a side wall of the associated clip-retaining member.

In such anchoring devices, each of the said clip-retaining members preferably has, at respective locations thereon spaced from the said base member, an inwardly-projecting portion which extends at least partially over the said opening such that, when said clip is retained by said device, said inwardly-projecting portions are located directly above at least part of each of the inner legs of the clip such that those portions serve to limit upward movement of the said inner legs.

In an anchoring device embodying the second aspect of the present invention, the roof of each passageway desirably has a portion which slopes downwardly, proceeding along said passageway in a direction away from the opening thereof into which an outer leg of a clip is inserted when the device is in use, for abutting the outer leg of the clip when the clip is being driven into the device so as to drive that leg downwardly with respect to said inner legs.

Preferably, in an anchoring device embodying the second aspect of the present invention, said base member is such that when each outer leg of the clip is inserted into the opening of a corresponding passageway of the device such that an upper part thereof abuts the roof of the passageway and a lower part thereof abuts the floor of the passageway at said opening thereinto, the fourth portion of the clip is supported by said base member.

Desirably, in an anchoring device embodying the second aspect of the present invention, opposing side faces of said clip-retaining members are not connected together by said base member along their entire lengths. Preferably, said base member connects only an end portion of one of the said clip-retaining members to an adjacent end portion of the other of the said clip-retaining members.

Preferably, an anchoring device embodying the second aspect of the present invention which is for use with a clip embodying the first aspect of the present invention includes second locating means for cooperating with first locating means on said clip.

Desirably, when such an anchoring device is in combination with such a clip, the roof of one or each of the passageways of the anchoring device is provided with a downwardly-directed projection for engaging with the recess provided on the corresponding outer leg of the clip.

Preferably in such an anchoring device and clip combination, said projection is located such that the clip is held in position in which the clip bears on an adjacent rail. Desirably, the roof of one or each of the passageways is provided with another downwardly-directed Projection for engaging with said recess which is preferably located such that the clip is held in a position in which the clip does not bear on an adjacent rail. Preferably, such projections are located at either end of one or each of the passageways.

According to a third aspect of the present invention there is provided a method of installing a clip embodying the first aspect of the present invention into an anchoring device embodying the second aspect of the present invention, in which the free ends of the rod forming the clip are inserted into respective openings of the passageways in the device such that an upper part of each outer leg abuts the roof of the passageway and the fourth portion of the clip is supported by the base member of the device, and the clip is driven such that the outer legs thereof are forced both along the passageways and downwardly with respect to the inner legs, thereby placing the clip under stress, the clip being driven until it reaches a desired location with respect to the device.

A clip embodying the first aspect of the present invention can, where necessary or preferable, be installed manually into an anchoring device embodying the second aspect of the present invention, but when the clip and anchoring device are provided with first and second locating means installation of the clip into the anchoring device is facilitated, particularly automatic installation by a clip driving machine.

According to a fourth aspect of the present invention there is provided a method of employing a clip embodying the first aspect of the present invention in combination with an anchoring device embodying the second aspect of the present invention, wherein at least one of the inner or outer legs of the clip is provided with first locating means for cooperating with second locating means provided on the anchoring device so as to locate the said clip at a desired position with respect to the said anchoring device when installed therein, wherein at least one abutment surface forms one of the first and second locating means and at least one cooperating projection forms the other of the first and second locating means, both the abutment surface and one face of the cooperating projection being acutely inclined in one sense to the longitudinal axis of the leg of the clip having said first locating means thereon such that the said one face of the said cooperating projection abuts against the said abutment surface so as to locate the clip, but such that driving of the clip in either of two directions parallel to the said axis forces said projection out of contact with said abutment surface, and wherein the outer legs of the clip are inserted into the passageways of the device such that the locating means on the clip and device cooperate to hold the clip in a first position before the clip is driven, and the clip is driven into a second position in which the clip is held by said locating means so as to bear on a railway rail adjacent to the device.

Preferably, in a method embodying the fourth aspect of the present invention, the clip is driven out of said second position back to said first position so that an insulator for electrically insulating the device from an adjacent railway rail, which insulator is located between the device and the rail, may be replaced without the need to move the device or the rail.

In an alternative method embodying the fourth aspect of the present invention, the clip is driven, either from said first position or said second position, into a third position between the first and second positions in which the clip does not bear on a railway rail adjacent to the device but retains on the device an insulator, for electrically insulating the device from the rail, located between the device and the rail.

According to a fifth aspect of the present invention there is provided an assembly comprising a railway rail, an anchoring device as claimed embodying the second aspect of the present invention positioned adjacent to a flange of the rail, and a clip embodying the first aspect of the present invention installed in the device, wherein the fourth portion of the clip bears on the rail flange.

Preferably, an assembly embodying the fifth aspect of the present invention further comprises a shoulder insulator, formed of electrically-insulating material for electrically isolating the anchoring device from said rail, located between the device and rail, the insulator having first and second plate-like parts which adjoin one another at an angle, greater than 0°, which is such that the first plate-like part of the insulator rests on a ledge portion of the anchoring device and the second part-like part of the insulator is in contact with a face of the anchoring device which adjoins said ledge portion and is adjacent to the foot of the rail, the insulator also having insulator locating means for locating the insulator relative to the said anchoring device.

Preferably, in such an assembly the anchoring device has an upstanding ridge portion which projects into a corresponding slot in part of the insulator constituting at least part of said insulator locating means.

Desirably, in an assembly embodying the fifth aspect of the present invention, at least part of said insulator locating means is constituted by a portion of the insulator which is located beneath part of said clip. Preferably, the free end of an outer leg of the clip lies above said portion of the insulator.

Preferably, an assembly embodying the fifth aspect of the present invention further comprises a clip insulator, formed of electrically-insulating material for electrically isolating said clip from the rail, which clip insulator is carried by a clip so as to surround the region thereon which bears on the rail. Desirably, said clip insulator comprises a substantially plate-like member formed in one main surface thereof with a channel shaped for receiving said clip, and preferably additionally comprises resilient projections overhanging part of said channel which deform under pressure to allow the insulator to be clipped onto or off the clip.

Alternatively, said clip insulator comprises an encapsulating pocket of insulating material within which that part of said clip which bears on the rail is retained.

BRIEF DESCRIPTION OF THE DRAWINGS

FIGS. 2A, 2B and 2C show respective plan, side elevational and rear elevational views of the clip shown in FIG. 1, and FIGS. 2D and 2E show respective enlarged plan and side elevational views of part of that clip;

FIGS. 3A, 3B and 3C show respective plan, side elevational and front elevational views of another clip embodying the first aspect of the present invention, and FIGS. 3D and 3E show respective enlarged side elevational and plan views of part of that clip;

FIG. 9A shows a plan view of another insulator shown in FIG. 1, FIG. 9B shows a cross-sectional view taken along the line A—A in FIG. 9A, and FIG. 9C shows a front elevational view of the insulator;

FIG. 10A shows a plan view of another clip insulator, FIG. 10B shows a cross-sectional view taken along the line A—A in FIG. 10A and FIG. 10C shows a front elevational view of the insulator;

FIGS. 11A and 11B show respective plan and side elevational views of a further clip insulator embodying the eighth aspect of the present invention;

FIG. 12A shows a plan view of yet another clip insulator, FIG. 12B shows a cross-sectional view taken along the line A—A in FIG. 12A and FIG. 12C shows a front elevational view of the insulator;

FIG. 1 shows an assembly comprising a resilient railway rail fastening clip 1 having a toe portion 14 which bears against a flange of a railway rail 2 supported by a rail foundation 3, the rail foundation 3 being cushioned from the rail 2 by means of a resilient rail pad 4 located between the base of the rail and the rail foundation 3. The rail clip 1 is held in place by an anchoring device or shoulder 5, the shoulder 5 having a pair of passageways 53 (only one of which is shown in FIG. 1) in which respective limbs 11, 17 (only limb 17 being shown in FIG. 1) of the clip are located. The toe portion 14 of the clip 1 carries an insulator 6 covering the lowermost surface of the toe portion 14, so that the toe portion 14 of the clip 1 bears on the rail flange through the insulator 6, which thereby insulates the clip 1 from the rail 2. Located between the rail 2 and the shoulder 5 is a "side post" insulator 7, for electrically isolating the shoulder 5 from the rail 2. The components in the assembly will now be described in more detail with reference to the remaining drawings.

As shown in FIGS. 2A, 2B and 2C, the clip 1 shown in FIG. 1 is substantially M-shaped in plan. It is made by bending a rod of resilient material which is, in this case, circular in cross-section (for example a steel rod 15 mm in diameter), so as to have, proceeding from one end A of the rod to the other end B, a straight first portion 11, a second portion 12 bent through 180°, a curved third portion 13, a fourth portion 14 which is bent through 180°, a curved fifth portion 15, a sixth portion 16 which is bent through 180° and a straight seventh portion 17. The first and seventh portions 11 and 17 of the clip constitute the outer legs of the M, the third and fifth portions 13 and 15 constitute the inner legs of the M, the second and sixth portions 12 and 16 join respective inner legs to the outer legs, and the fourth portion 14 of the clip joins together the inner legs. When viewed in plan, as in FIG. 2A, the fourth portion 14 of the clip extends beyond the free ends A and B of the first and seventh portions 11 and 17.

The second and sixth portions 12 and 16 of the clip 1 rise out of the plane containing the first and seventh portions 11 and 17 of the clip 1 such that no rising part of the longitudinal axes of those portions 12 and 16 is inclined to that plane by an angle greater than about 33°, although in other embodiments of this invention this angle may be up to 40°.

The third and fifth portions 13 and 15 of the clip 1 are curved such that their longitudinal axes lie in respective planes which are substantially perpendicular to the plane containing the first and seventh portions 11 and 17 of the clip. Each of the third and fifth portions 13 and 15 in the illustrated embodiment has a first substantially straight part 13*a*, 15*a* and a second substantially straight part 13*b*, 15*b*, the longitudinal axes of which parts are inclined to one another at an angle of about 30°. However, the first and second parts 13*a*, 13*b*, 15*a*, 15*b* of the third and fifth portions 13 and 15 could themselves be curved so that the third and fifth portions 13 and 15 are curved more smoothly overall.

Figure 1:
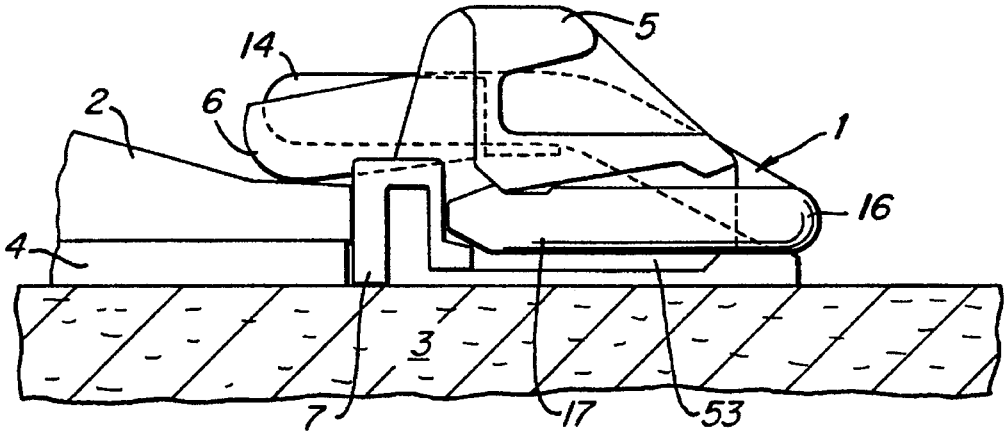
FIG. 1 shows a railway rail fastening assembly embodying the fifth aspect of the present invention, including a rail clip embodying the first aspect of the present invention, an anchoring device embodying the second aspect of the present invention, and respective shoulder and clip insulators.

When a clip is bearing on the rail, as shown in FIG. 1, a plane containing the longitudinal axis of the fourth portion 14 is substantially parallel to the plane containing the first and seventh portions 11 and 17.

Figure 2A:
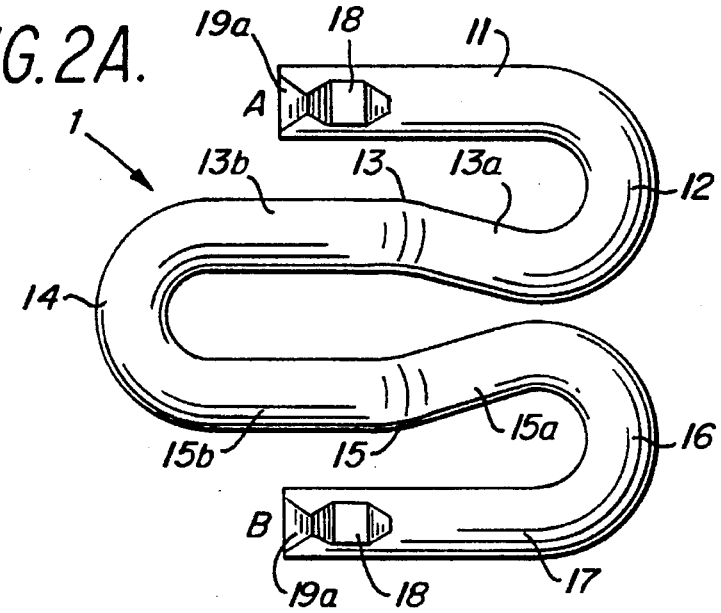
Figure 2B:
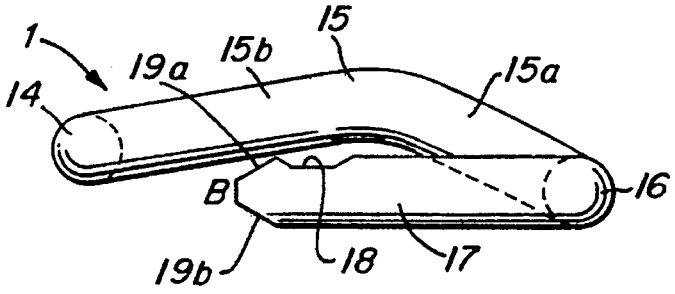

For the clip shown in FIGS. 2A to 2C, the ratio of the maximum distance between the longitudinal axes of the third and fifth portions 13 and 15 and the plane containing the first and seventh portions 11 and 17 to the diameter of the rod forming the clip is 1.23. A preferred maximum value for this ratio is 2.0, but it could be as high as 4.0.

The outer legs of the clip, i.e. the first and seventh portions 11 and 17 thereof, are each provided with detents 18 on their upper surface adjacent to the respective free ends A and B of the clip. The end B of one of the outer legs of the clip (which in this embodiment is identical to the other outer leg) is shown in more detail in FIGS. 2D and 2E.

In this embodiment, the detents 18 are each shaped so as to have two faces 18*a*, 18*b* which are inclined in opposite respective directions with reference to the longitudinal axes of the first and seventh portions 11 and 17 and another face 18*c* forming the floor of the detent 18 which joins together the inclined faces 18*a*, 18*b* and is itself substantially parallel to the longitudinal axes of the first and seventh portions 11 and 17. In this embodiment, the inclined faces 18*a*, 18*b* are inclined at an angle of 30° with respect to the longitudinal axes of the first and seventh portions 11 and 17. The floor 18C of the detent serves to space apart the inclined faces 18*a*, 18*b* of the detent 18, but in an alternative embodiment this floor 18*c* may be omitted so that there is no space between the lowermost edges of the inclined faces 18*a*, 18*b* of the detent 18.

The detent 18 is preferably on the uppermost surface of the first and seventh portions 11 and 17 of the clip as shown, rather than on a lateral face thereof, so that when the clip 1 is installed in an anchoring device 5 the force on the outer legs of the clip caused by the engagement of the anchoring device 5 with the detents 18 is in substantially the same direction as the stress acting on the second and sixth portions 12 and 16 of the clip 1 owing to deflection of the outer legs.

Each free end A,B of the clip 1 is tapered on its upper and lower surfaces, the upper and lower tapered surfaces 19*a*, 19*b* being in this embodiment at an angle of approximately 30° with respect to the longitudinal axis of the clip. In the present embodiment the detent 18 is formed Just behind the tapered part 19*a* of the upper surface. As will be clear from the description of FIGS. 10A to 10C later on, the taper 19*a* on the upper surface of the outer leg is intended to ease insertion of the clip 1 into an anchoring device 5. The taper 19*b* on the lower surface of the outer leg is intended to facilitate use of the clip in holding the insulator 7 in place between the anchoring device 5 and the rail 2.

In such an embodiment of the clip made from a rod of diameter 15 mm:- the inwardly-facing surfaces of the outer legs are 75 mm apart; the distance between the outermost part of the fourth portion 14 and a line joining the outermost parts of the second and sixth portions 12 and 16 is 120 mm; the maximum height of the clip, i.e. the height between the uppermost point of the third portion 13 of the clip above the lowermost point of the first and seventh portions 11 and 17 of the clip, is 34 mm; the lowermost point of the fourth portion 14 of the clip is 10 mm above the lowermost portion of the first and seventh portions 11 and 17; the outermost portion of the fourth portion 14 extends 40 mm beyond the free ends A and B of the outer legs; the second parts 13*b*, 15*b* of the third and fifth portions 13 and 15 are each 42 mm long; the radius of curvature of the second and sixth portions is 10, whilst that of the fourth portion is 9; the upper surface of the outer legs are tapered to a distance of 8 mm from the free end of the leg, the lower surface of the outer legs being tapered to a distance of 10 mm from the end of the leg; each detent 18 is 1.5 mm deep, being 9 mm across at its widest part perpendicular to the longitudinal axis of the outer leg, having a floor 18*c* 8.5 mm long as measured in the direction parallel to the longitudinal axis of the outer leg, and being 15.5 mm long overall; in forming the detent 18 and the upper face taper 19*a*, material is preferably taken away from the end of the free leg such that it has a diameter of 14.5 mm as measured across the leg at the point where the upper face taper 19*a* meets the detent 18; the angle $\alpha$ shown in FIG. 2C is about 12°, but could in other embodiments be 19° for example or up to 25°.

A modified form of the clip shown in FIGS. 2A to 2E is shown in FIGS. 3A to 3E. The clip of FIGS. 3A to 3E differs from that of FIGS. 2A to 2E in that the third and fifth portions 13 and 15 thereof have respective first parts 13*a* and 15*a* which are slightly curved, the second parts 13*b* and 15*b* remaining straight, such that the overall height of the clip is reduced in comparison to that of FIGS. 2A to 2E. In addition, the free ends of the outer legs 11, 17 of the clip 1 are rounded at their tops 19*a*' and are chamfered at lateral parts 19*c* thereof, so as to ease insertion of the clip into an anchoring device.

Figure 4A:
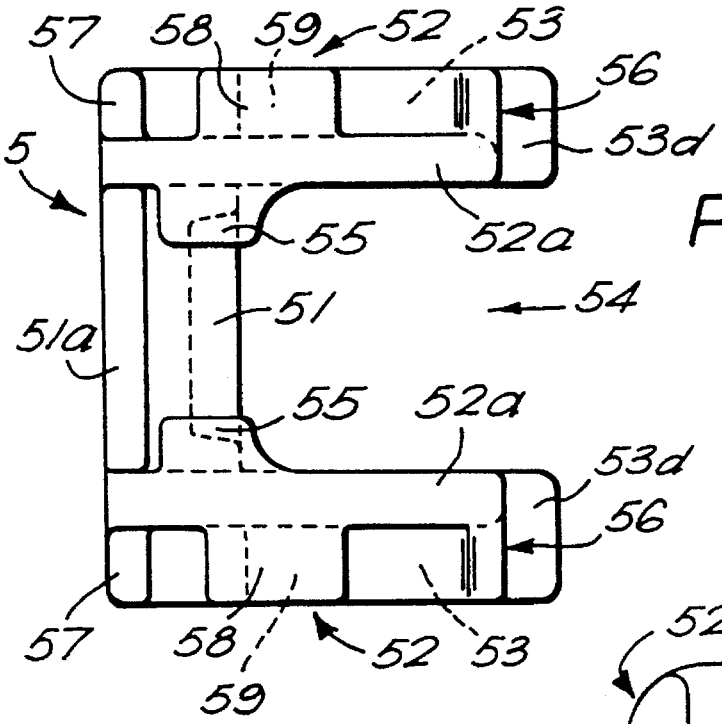
FIGS. 4A, 4B and 4C show respective plan, side elevational and front elevational views of the anchoring device shown in FIG. 1.
Figure 4B:
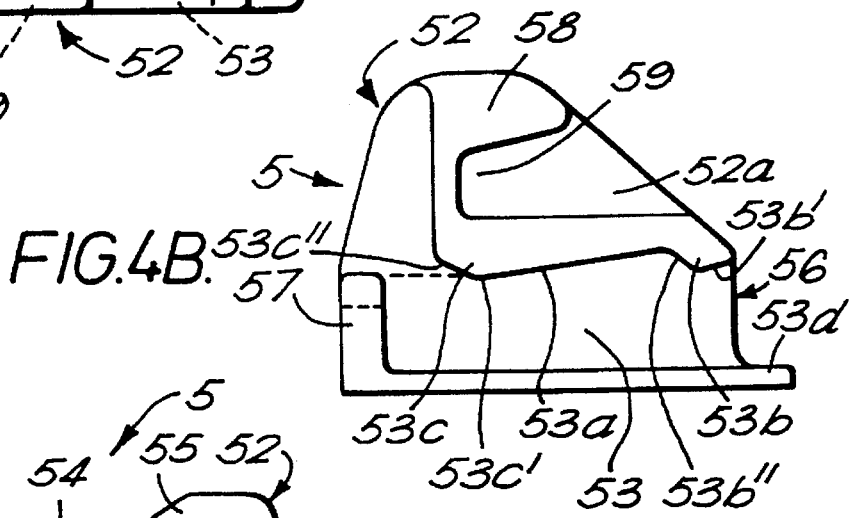
Figure 4C:
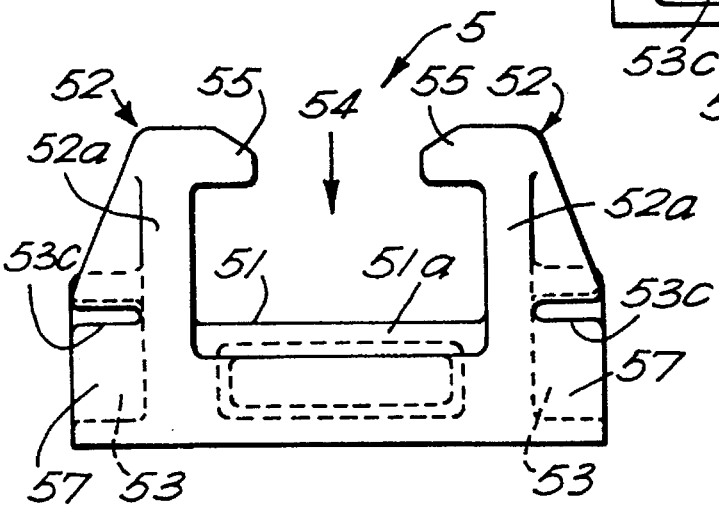
Figure 5A:
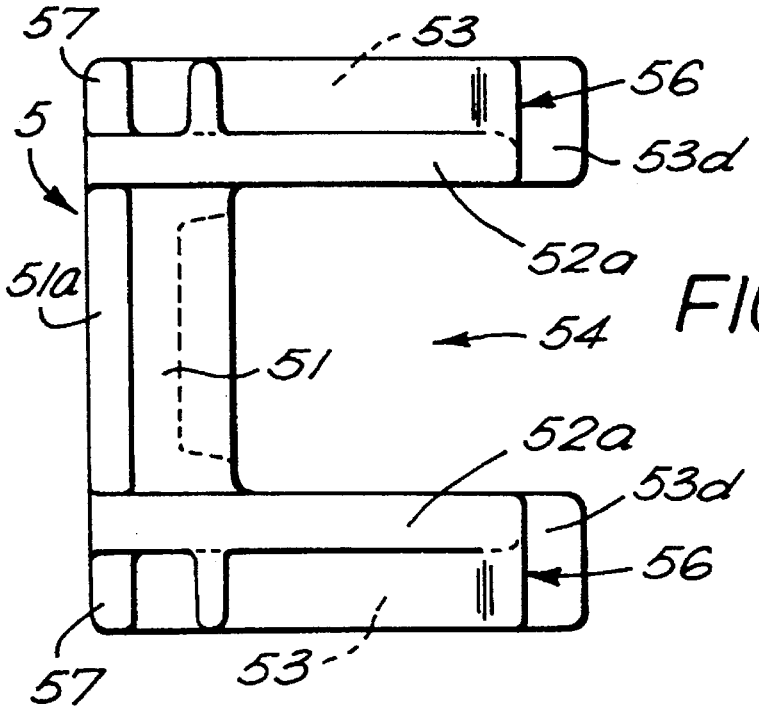
FIGS. 5A, 5B and 5C show respective plan, side elevational and front elevational views of an alternative form of anchoring device embodying the second aspect of the present invention.
Figure 5B:
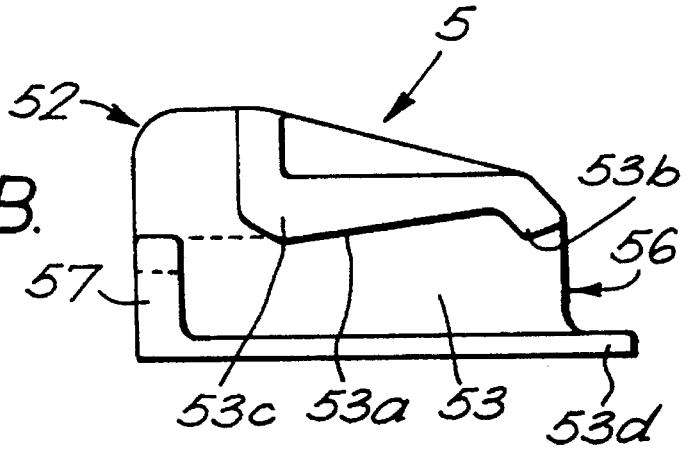
Figure 5C:
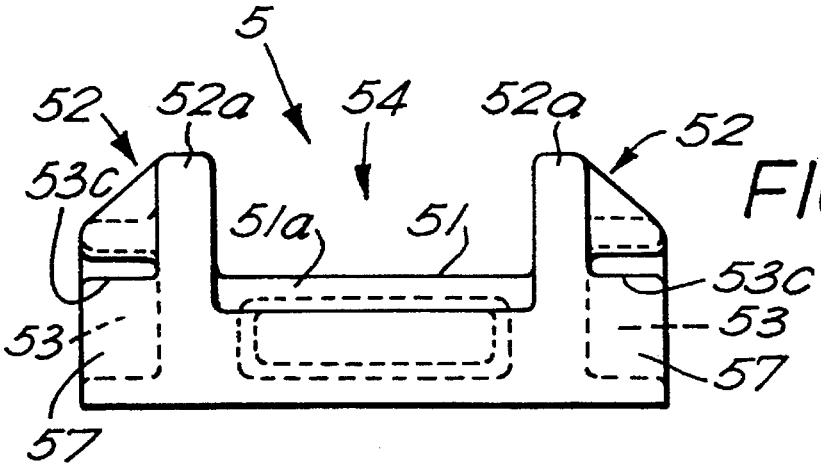
Figure 6A:
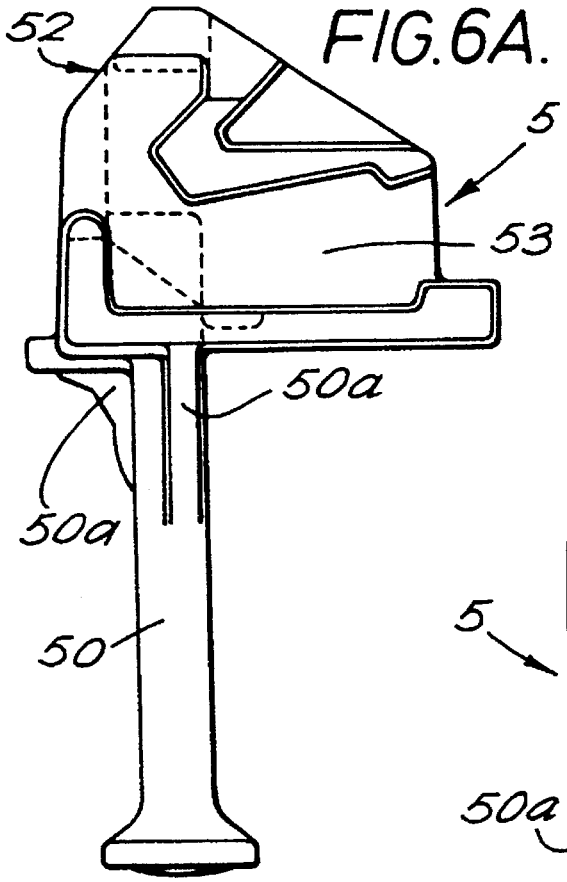
FIGS. 6A, 6B and 6C show respective side elevational, front elevational and plan views of another alternative form of anchoring device embodying the second aspect of the present invention.
Figure 6B:
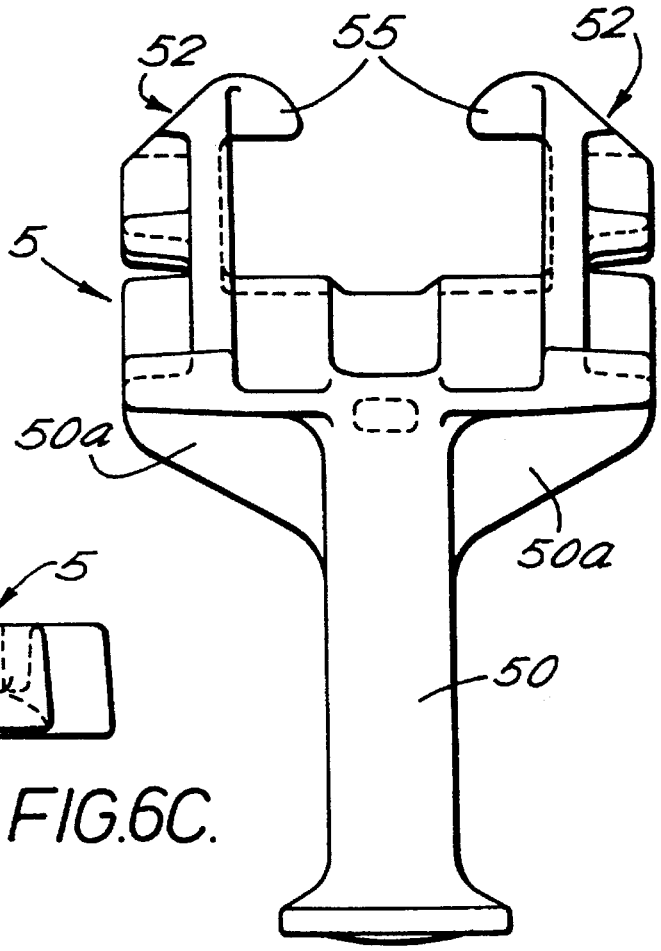
Figure 6C:
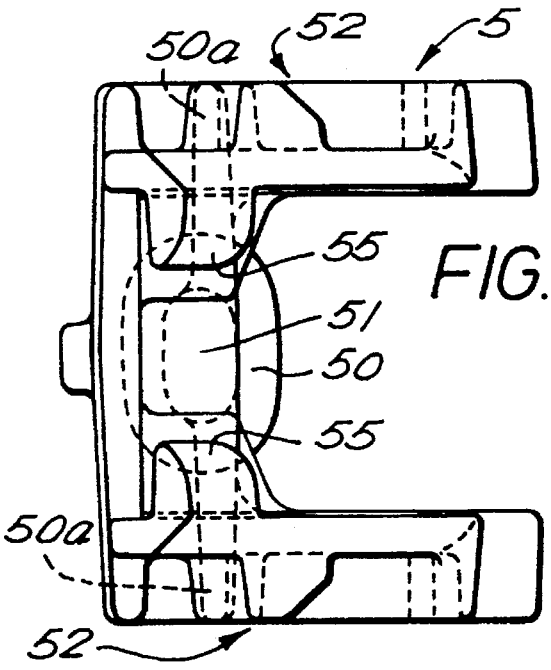
Figure 6D:
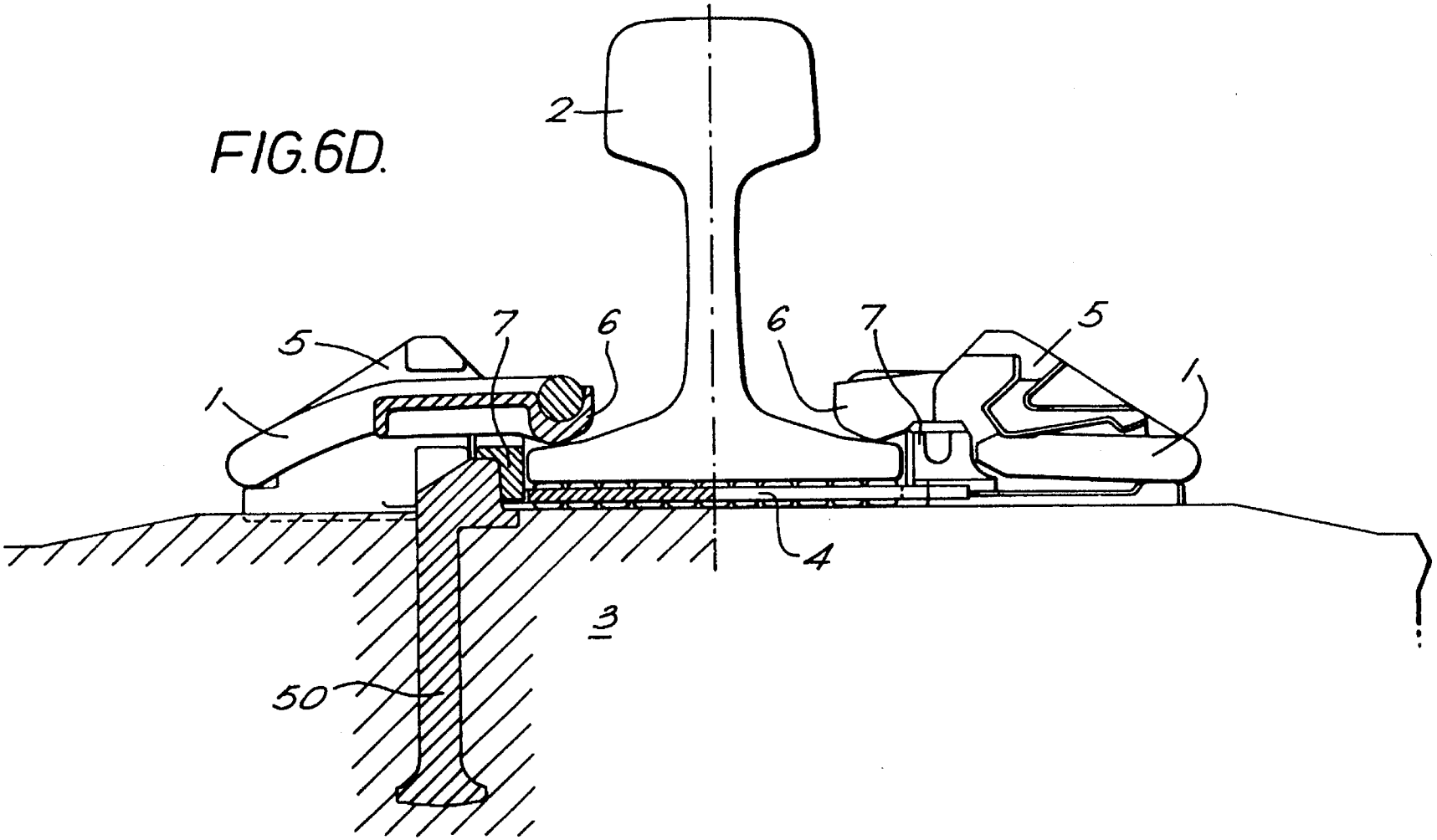
FIGS. 6D, 6E and 6F show respectively a side elevational view in partial cross-section, a front elevational view in partial cross-section, and a plan view of an assembly incorporating the anchoring device of FIGS. 6A to 6C in combination with the clip of FIGS. 3A to 3E.
Figure 6E:
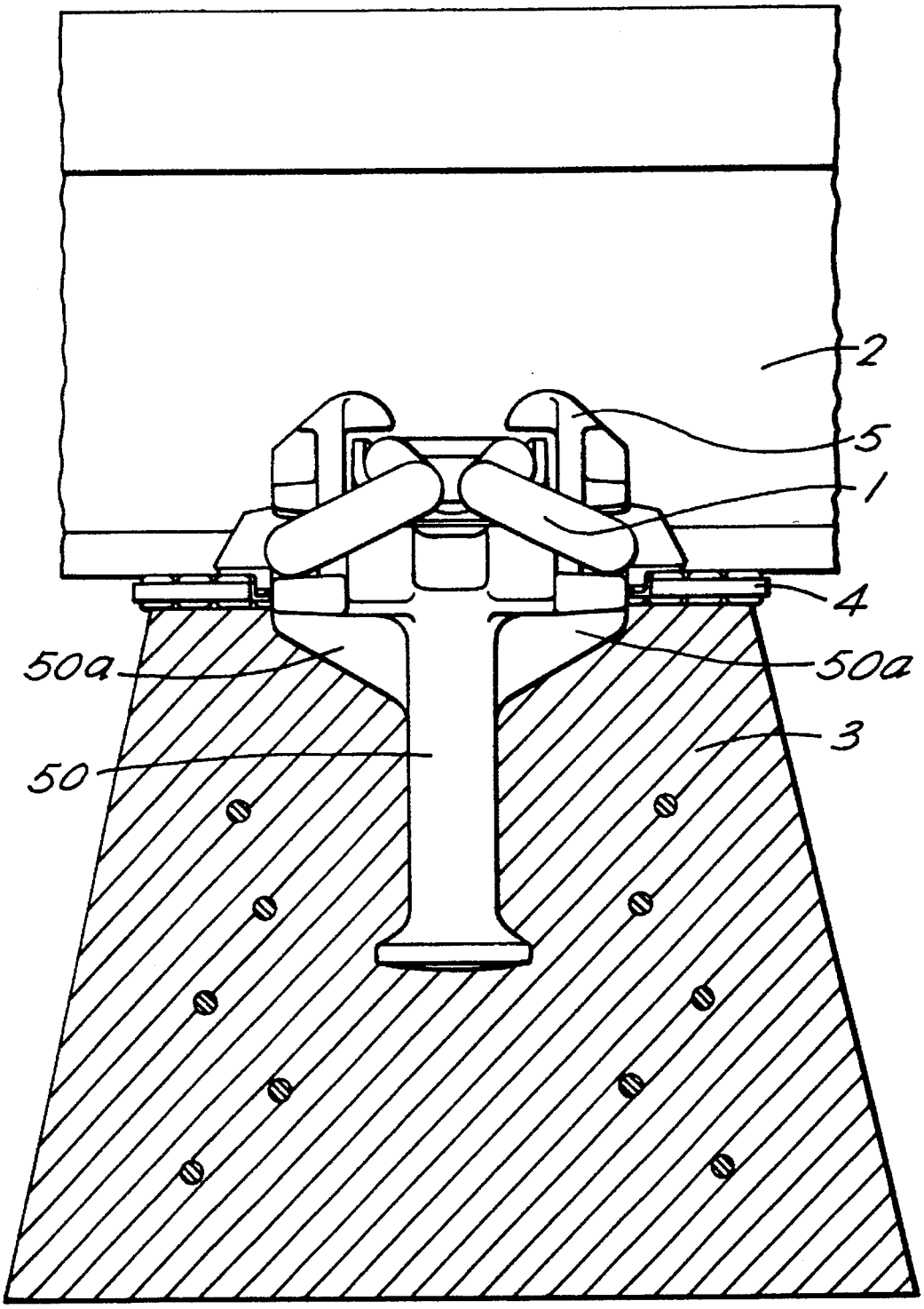
Figure 6F:
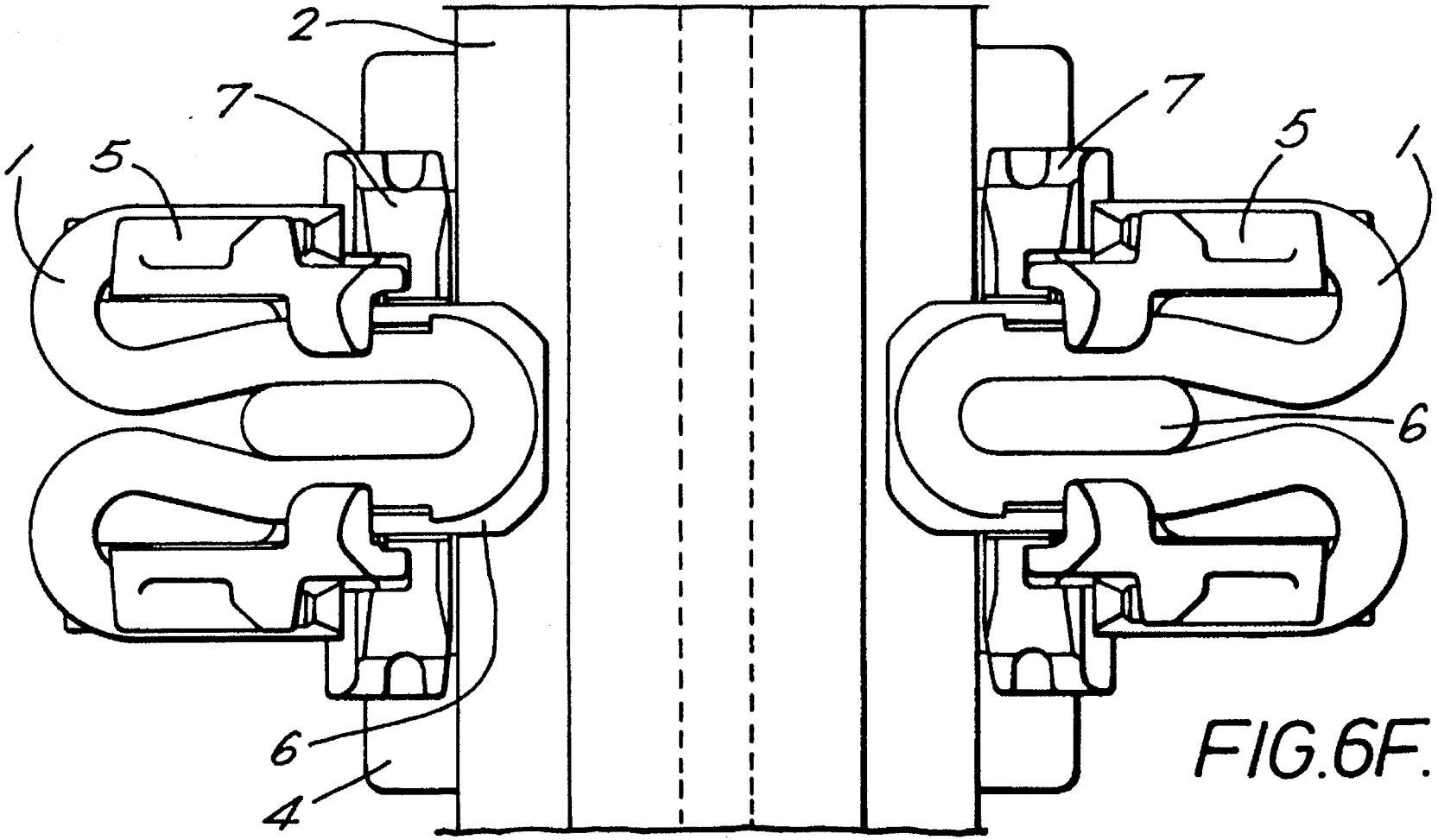

The clip shown in FIGS. 2A to 2E, or that shown in FIGS. 3A to 3E, may be used, as shown in FIG. 1, with an anchoring device as shown in FIGS. 4A to 4C, although this anchoring device may be modified in some respects, for example as shown in FIGS. 5A to 5C.

The anchoring devices 5 of FIGS. 4A to 4C and 5A to 5C comprise a base member 51, which extends substantially horizontally when the device is in use, and a pair of clip-retaining members 52 which are connected at one end thereof to either end of the base member 51 so as to extend substantially perpendicularly thereto both vertically and horizontally. A channel formed in the outwardly-facing wall of each clip-retaining member 52 provides a passageway 53 for receiving the outer legs of the clip of FIGS. 2A to 2E. The clip-retaining members 52 are spaced apart by the base member 51 so as to define an opening 54 therebetween for receiving the inner legs of the clip. Overhanging the opening 54 from the top of each clip-retaining member 52 are inwardly-extending projections 55, which projections 55 serve to limit upward movement of the inner legs of the clip which may occur due to rail tilt when the clip is in use. Each passageway 53 has an opening 56 at the end of the clip retaining member 52 which is furthest from the base member 51, but is closed by a wall 57 at the other end of the clip-retaining member 52 so as to provide means by which the insulator 7 may be located on the anchoring device 5, as will be explained later in more detail. For this purpose also, the roof of the passageway adjacent to the wall 57 is removed.

When the anchoring device 5 is in use, the floor of the passageway 53 is substantially horizontal. The passageway 53 has only one side face, constituted by a wall 52*a* of the clip-retaining member 52 formed so as to lie between the outer and inner legs of the clip 1 when in use, the other side of the passageway being open. The roof of the passageway 53 is formed so as to have a sloping part 53*a* which is inclined with respect to the horizontal when the device is in use such that the passageway is taller at the part of that sloping part 53*a* which is closer to the opening 56 than it is at the other end of the part 53*a*, the roof of the passageway 53 being formed at either end of the sloping part 53*a* in such a way as to provide projections 53*b* and 53*c* for cooperating with the detent 18 formed in the outer leg of each clip 1 for locating the clip 1 at a particular location with respect to the anchoring device 5.

The first projection 53*b* which is formed at the opening 56 of the passageway 53 presents to the opening 53 a first face 53*b'*, which is fairly shallowly inclined to the horizontal in a direction such that the height of the passageway decreases proceeding towards the wall 57. The projection 53*b* then has a second face 53*b"*, which is more steeply inclined with respect to the horizontal, but in the opposite sense, than the first face 53*b'* such that the height of the passageway increases. The second projection 53*c* which is formed closest to the wall 57 has a first face 53*c'* forming the sloping part 53*a* and a second face 53*c"* which is inclined in the opposite sense with respect to the horizontal by an angle which is greater than the angle of inclination of the sloping part 53*a*, but is smaller than the angle of inclination of the second face 53*b"* of the first projection 53*b*. Extending from each wall 52*a* of the clip-retaining members 52 in a region above the passageways 53 is a part 58 such that between the passageway 53 and the part 58 there is defined a recess 59 into which a tool, for installing a clip into or removing a clip from the device, or for lifting a sleeper to which a pair of anchoring devices 5 have been secured, may be inserted. The roof of the recess 59 may be sloped along one edge as shown. The wall 52*a* of each clip-retaining member 52 may be rounded or sloped along one edge as shown so as to reduce the amount of material required to make the anchoring device 5.

The floor of the passageway 53 is preferably extended beyond the opening 56 so as to provide a part 53*d* against which the lower surface of the outer legs of the clip may rest when the clip is about to be installed in the device 5. The base member 51, which provides a support for the fourth portion 14 of the clip 1 when it is not bearing on the rail, is in this embodiment intended (when in use) to receive a side post insulator 7, a step 51*a* being provided in the face of the base member 51 which is closest to the rail 2 when the device 5 is in use for receiving a horizontally-extending part of the insulator 7. It should be noted, however, that this step 51*a* would not be required if the anchoring device 5 were to be used with a conventional insulator for electrically isolating the device from the rail.

Further savings in the material needed to make the device 5 may be achieved by omitting the overhanging projections 55, thereby enabling the overall height of the anchoring device 5 to be reduced, as shown in FIGS. 5A to 5C. The parts 58 have also been omitted from the device of FIGS. 5A to 5C, although the upper part of this device 5 could be modified so as to provide a recess for receiving installation or lifting tools.

In one embodiment of the anchoring device shown in FIGS. 4A to 4C, for use with a clip as described with reference to FIGS. 2A to 2E, the overall height of the anchoring device is 60 mm and its overall width is 101 mm. The clip-retaining members 52 define an opening between them which is 57 mm wide, the walls 52*a* being 9 mm wide. The lowermost surface of each overhanging part 55 is 46 mm above that part of the anchoring device which will be level with surface of the rail foundation 3 when the device is in use, the separation between the overhanging parts 55 being 32 mm. The part 53*d* extends beyond the opening 56 of the passageway 53 a distance 11 mm, the length of the passageway from the inner wall 57 to the opening 56 being 77 mm. The wall 57 is 8 mm thick as measured in a direction parallel to the length of the passageway 53 and is 21 mm high. The thickness of the floor of the passageway is 3 mm and the height of the passageway at the opening is 22 mm. The height of the passageway then decreases at an angle of about 13° to a height of 20 mm before increasing again at an angle of about 45° to a height of 24 mm. The sloping part 53*a* of the passageway roof is inclined at an angle of about 18° and at its lowermost point 18.5 mm above the floor of the passageway 53. The second face 53*c"* of the second projection 53*c* is inclined at an angle of 30° to a height of 24 mm, the lowermost point of the second projection 53*c* being 26 mm from the outer face of the wall 57. The lowermost point of the first projection 53*b* is 68 mm from the outer face of the wall 57. The recess 59 above the passageway 53 has an upper surface which is inclined at an angle of about 15° starting at a height of 44 mm above the lowermost point of the anchoring device and increasing to 51 mm, the floor of the recess being 32 mm above the lowermost point of the anchoring device. The step 51*a* formed in the base member 51 is formed at a height of 15 mm above the lowermost point of the anchoring device and is of depth 8 mm.

The anchoring devices 5 of FIGS. 4A to 4C and FIGS. 5A to 5C may, as shown in FIGS. 6A to 6F, be secured to a concrete rail foundation by means of a stem 50 provided so as to project from the base member 51 thereof. The stem 50, forming an integral part of the anchoring device 5, is embedded in the concrete sleeper 3 during manufacture of the sleeper 3 and is provided with vanes 50*a* to counteract any tendency of the anchoring device 5 to rotate in the sleeper 3.

Figure 7A:
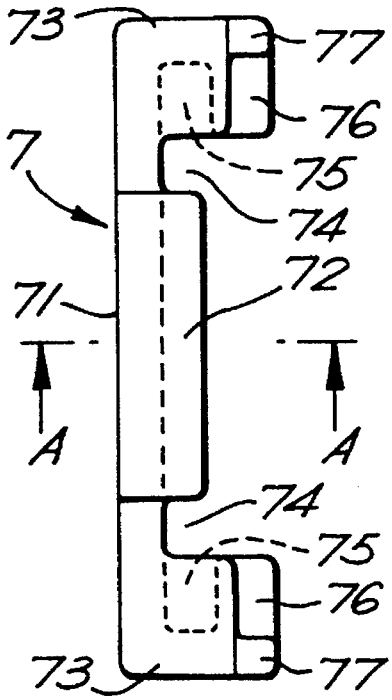
FIG. 7A shows a plan view of an insulator shown in FIG. 1.
Figure 7B:
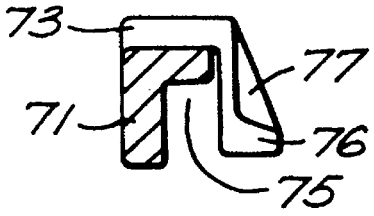
FIG. 7B shows a cross-sectional view taken along the line A—A in FIG. 7A.
Figure 7C:
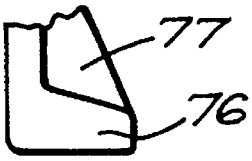
FIG. 7C shows an enlarged view of part of FIG. 7B.

The insulator 7 shown in FIG. 1 will now be described in more detail with reference to FIGS. 7A to 7C. The insulator has a first plate 71 which, when the insulator is in use, is located between the anchoring device 5 and the rail 2. Projecting perpendicularly from a central portion of the top edge of the first plate 71 is a second plate 72 which is shaped such that when in use it can be located in the step 51*a* of the anchoring device 5 so as to provide an unbroken flat surface on the base member 51. The first plate 71 is lower at its central portion that it is at either end, there being provided at either end of the first plate 71 upstanding insulator locating members 73 which extend perpendicularly to the first plate 71. These insulator locating members 73 are spaced from the second plate 72 so as to provide respective recesses 74 for receiving the walls 52*a* of the clip-retaining members 52 of the anchoring device 5. The locating members 73 are each formed in a lower face thereof with a slot 75, extending parallel to the first plate 71, for receiving the wall 57 of the anchoring device 5 when the insulator is in use, thereby preventing the insulator 7 from moving in a horizontal direction during use but allowing the insulator to be removed from the anchoring device 5, for example for replacement due to wear, by being lifted in a vertical direction. Extending from the bottom of a face of each insulator locating member 73 remote from the first plate 71 is a locating foot 76 having an inclined upper surface. When the insulator 7 is located on an anchoring device 5 and a clip 1 is fully installed in that device 5, the lower tapered surface **19*b* at the free end of each outer leg of the clip rests on the upper surface of the locating foot 76 so as to prevent lifting of the insulator 7 to an undesirable extent during use. Connecting one side of the upper surface of the locating foot 76 to the insulator locating member 73 is a wall 77**.

Figure 8B:
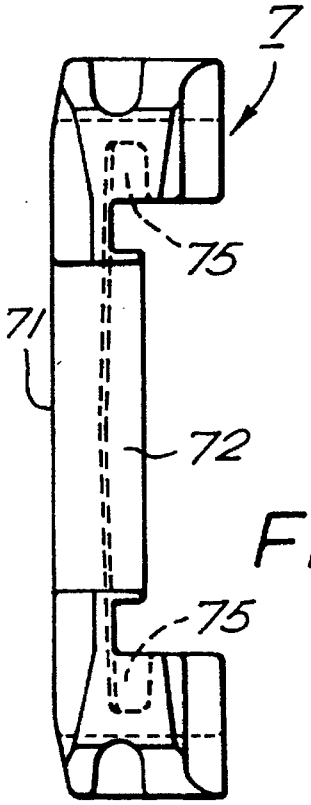
FIGS. 8A and 8B show respectively plan and front elevational views of another shoulder insulator.
Figure 8A:
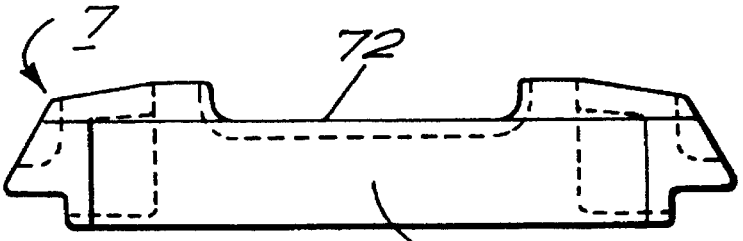
Figure 13A:
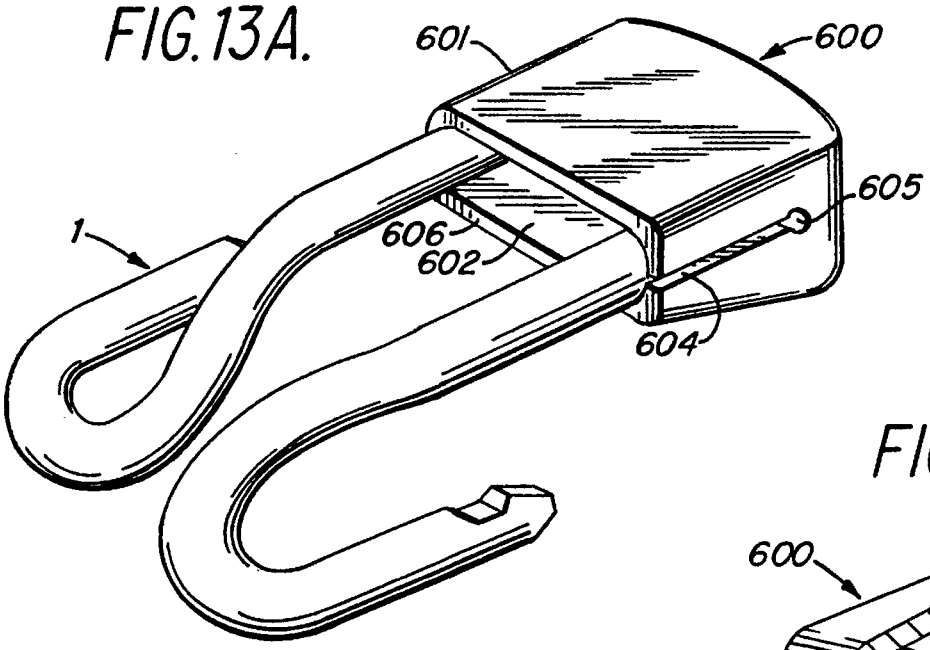
FIGS. 13A, 13B and 13D show respective perspective, side elevational and front elevational views of a yet further clip insulator.
Figure 13E:
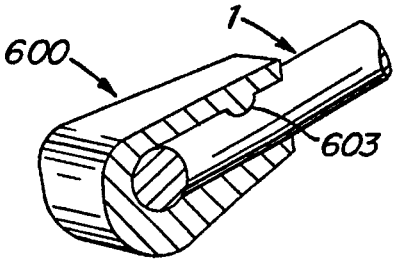
FIG. 13E shows an enlarged cut-away view of part of FIG. 13A.
Figure 13B:
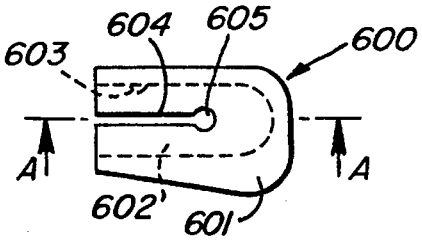
Figure 13C:
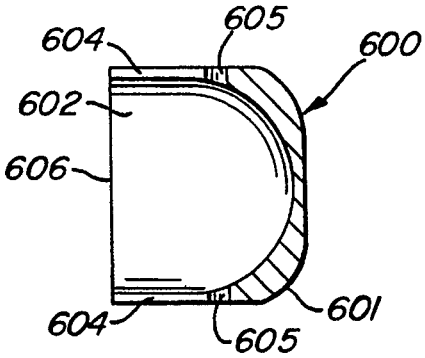
FIG. 13C shows a cross-sectional view taken along line A—A in FIG. 13B.
Figure 13D:
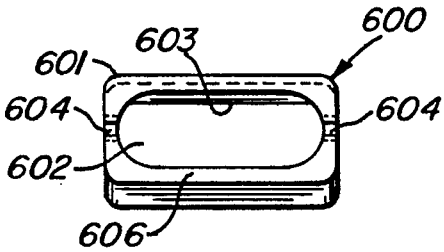

Another form of shoulder insulator 7 is shown in FIGS. 8A and 8B.

An embodiment of the insulator 7 intended for use with an anchoring device 5 as described with reference to FIGS. 4A to 4C or 5A to 5C has: a first plate 71 which is 119 mm long, 20 mm high at its central part and 26 mm high at the remainder, being 8 mm thick; a second part 72 which is 55 mm long, 15.5 mm wide and 6 mm thick; an insulator locating member 73 which is 21.5 mm long, 26 mm high and 19.5 mm wide; a recess 74 which is 10.5 mm wide; a slot 75 which is 20 mm high, 8.5 mm wide and 13 mm long, there being a thickness of material of about 8 mm forming two of the three vertical walls of the slot; and a locating foot 76 which is 3.5 mm thick at its thinnest point, having an upper surface inclined at an angle of 16° to the horizontal, the locating foot being 15.5 mm long, 8.5 mm wide and having a lower surface which is 2 mm above the lowermost point of the first plate 71.

The toe insulator 6 of FIG. 1 will now be described in more detail with reference to FIGS. 9A to 9C. Similar toe insulators are shown in FIGS. 10A to 10C and FIGS. 11A and 11B. Each of the toe insulators 6 shown in FIGS. 9A to 9C, 10A to 10C, and 11A and 11B, comprises a body 60 made of a block of insulating material having a main face, which is uppermost when the toe insulator 6 is being carried by a clip 1 in use, which is formed with a channel 61 shaped so as to receive the fourth portion 14 of the clip 1 and adjoining parts of the third and fifth portions 13 and 15 of the clip. The underside of the body 60 is rounded and shaped so as to ease movement of a clip carrying the toe insulator 6 onto and off a rail, and also to reduce, where possible, the amount of material needed to make the insulator 6, the thickness of the material being greatest at those parts which underlie the channel 61. Overhanging the channel 61 at the parts which receive the third and fifth portions 13 and 15 of the clip 1 when in use are resilient projections 62 which deform when the clip is pressed against them so as to allow the clip to enter the channel, but act also as to retain the toe insulator 6 on the clip 1 in normal use.

In the toe insulator 6 of FIGS. 9A to 9C, the material 63 bounded by the inner wall of the channel 61 is reduced in height as compared to the material forming the outer boundaries of the channel such that it forms a comparatively low protrusion which is inclined such that its height above the lowermost point of the channel 61 decreases to zero at the part between the third and fifth portions 13 and 15 of the clip 1. For added stability of the toe insulator 6 on the clip the body 60 is formed so as to have a tab 64.

The toe insulator of FIGS. 10A to 10C differs from that of FIGS. 9A to 9C primarily in that the part **63*a*, defined by the channel 61 between the parts which accept the third and fifth portions 13 and 15 of the clip 1, has an upper surface at the same level as the uppermost point of the material forming the outer boundary of the channel 61, and, instead of the tab 64, extends out beyond the ends of the channel 61 so as to add stability to the insulator 6. To save material, the underside of the part 63*a* is formed with a recess 65. In addition to the underside of the body 60, the corners of the upper main face are also rounded off, approximately following the curvature of the channel 61** in that region.

The toe insulator 6 of FIGS. 11A and 11B differs from that of FIGS. 9A to 9C in that a part **63*b*, bounded by the parts of the channel 61 which receive the third and fifth portions of the clip 13 and 15, has an upper surface which is at the same level as the material bounding the outer wall of the channel 61 and extends beyond the main part of the body 60 so as to form an elongate tab 64*a*, the upper surface of the tab being slightly rounded and the lower surface of the tab being more rounded, and the thickness of the tab 64*a* decreasing both laterally and longitudinally as one progresses away from the main part of the body 60**.

A modified form of the insulator shown in FIGS. 10A to 10C is shown in FIGS. 12A to 12C. One difference between the two insulators is that the insulator of FIGS. 12A to 12C has a less rounded underside, thereby reducing the amount of material required for the insulator. In addition, the channel 61 extends further around each side of the part **63*a*. Furthermore, the free edges 62*a* of the projections 62** are chamfered so as to permit easier fitting of the clip.

An alternative form of toe insulator, which could be used with the clip of FIGS. 2A to 2E or 3A to 3E will now be described with reference to FIGS. 13A to 13E. The toe insulator 600 has a body 601 formed of insulating material shaped so as to provide a recess 602 for receiving the fourth portion 14 of the clip 1 such that the fourth portion 14 is completely encapsulated. The insulator 600 is held on the fourth portion 14 of the clip 1 by means of a elongate projection 603 which projects from the ceiling of the recess 602 and engages with the clip 1 to facilitate fitting of the toe insulator 600 onto the fourth portion 14 of the clip. The sides of the toe insulator 600 are provided with slits 604, cooperating with holes 605 at one end thereof, running from the opening 606 of the recess 602 approximately two thirds of the length of the side face of the insulator 600, which slits allow the opening 606 to be enlarged slightly as the insulator is fitted onto the fourth portion 14 of the clip 1. The recess 602 is shaped so as to match the outer periphery of the fourth portion 14 of the clip 1, the opening 606 thereto being shaped substantially like a stadium race track. The thickness of material of the insulator at the part which will be uppermost when it is in use is substantially uniform, but the part of the insulator which will be lowermost when the clip is in use, i.e. which will bear on the rail, increases steadily proceeding away from the end of the insulator adjacent to the opening 606.

An embodiment of the toe insulator 6 of FIGS. 9A to 9C for use with a clip 1 as described with reference to FIGS. 2A to 2E has: a body 60 which is 55 mm wide and 50 mm long excluding the tab 64, which is 22 mm wide, 3 mm thick and 20.5 mm long, the body 60 being 22.5 mm high overall in the region of the parts 62, and 19 mm high overall in the region around the channel 61, there being a maximum thickness of material of about 7.5 mm around the channel 61, and the underside of the body 60 being inclined with respect to the underside of the tab 64 by an angle β of 12°; a channel 61 having an outer periphery with radius of curvature of 24 and an internal radius of curvature of 7.5; a part 63 which has a maximum height of 4 mm above the lowermost point of the channel; and parts 62 which start 28 mm back from the front of the body 60 and are 42.5 mm apart.

An embodiment of the toe insulator 6 of FIGS. 10A to 10C for use with a clip 1 as described with reference to FIGS. 2A to 2E is similarly dimensioned with respect to corresponding parts as the insulator described above, but has a part 63*a* which is 55 mm long and 17 mm wide, with a slot 65 which is 49 mm long and 10 mm wide.

An embodiment of the toe insulator 6 of FIGS. 11A and 11B for use with a clip 1 as described with reference to FIGS. 2A to 2E has: a body 60 which is 55 mm wide and 44 mm long, the part 64a extending beyond the body 60 a distance 40 mm, the overall height of the insulator being 19 mm at the front and 24 mm at the rear, and the underside of the body being inclined at an angle β of 12°; and a part 64*a* which is 18 mm wide at its widest part and 14 mm at its narrowest, having an upper surface with a radius of curvature of 25 and a lower surface with a radius of curvature of 17 which is inclined at a part close to the body 60 at an angle γ of 32°.

A preferred form of the insulator 600 shown in FIGS. 13A to 13E for use with a clip as described with reference to FIGS. 2A to 2C has: an opening 606 which is 48 mm wide and 16 mm high, there being 4 mm of material above the recess, and a minimum of 4 mm of material and a maximum of 8 mm of material beneath the recess; sides formed with the slots 604 which are 2 mm thick, the slit being 25 mm long; a recess 602 which is 40 mm deep, there being 4 mm of material at the end of the recess; and a projection 603 which is formed 10 mm from the opening 606 of the recess 602.

Installation of the clip 1 into an anchoring device 5 as shown in FIG. 1 will now be explained with reference to FIGS. 14A to 14C (the toe insulator 6 that would normally be carried by the clip 1 being omitted for clarity in these Figures).

Figure 14A:
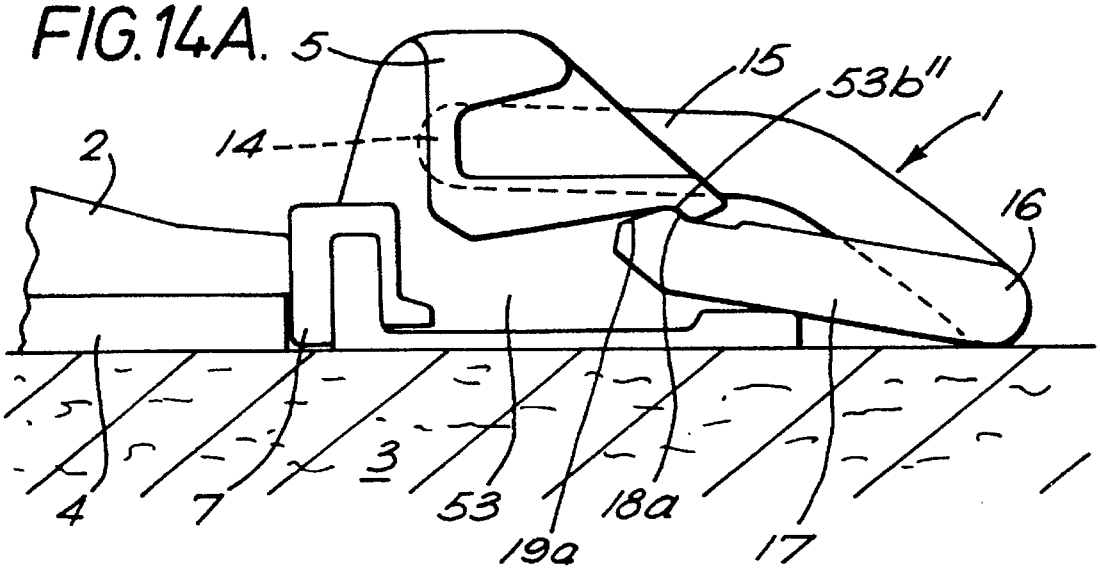
FIGS. 14A, 14B and 14C show views for use in explaining respective steps of a method embodying the fifth aspect of the present invention.

FIG. 14A shows the clip in an initial position, as it is when it is about to be driven into the device 5, with the fourth portion of the clip 1 resting (via a toe insulator 6, not shown) on the base member 51 of the anchoring device 5 and the outer legs of the clip 1 just inside the passageways 53 of the anchoring device 5 such that part of the lower surface of the outer legs rests on the portion 53*d* of the anchoring device 5, the face 18*a* of the detent 18 which is closest to the free end of the outer leg is in contact with the second face 53*b*" of the projection 53*b*, and the upper tapered surface 19*a* of the outer leg is partly in contact with the sloping part 53*a* of the roof of the passageway 53. In this position the clip is only partially deflected, for example only 2 mm out of a total deflection of 12 mm.

Figure 14B:
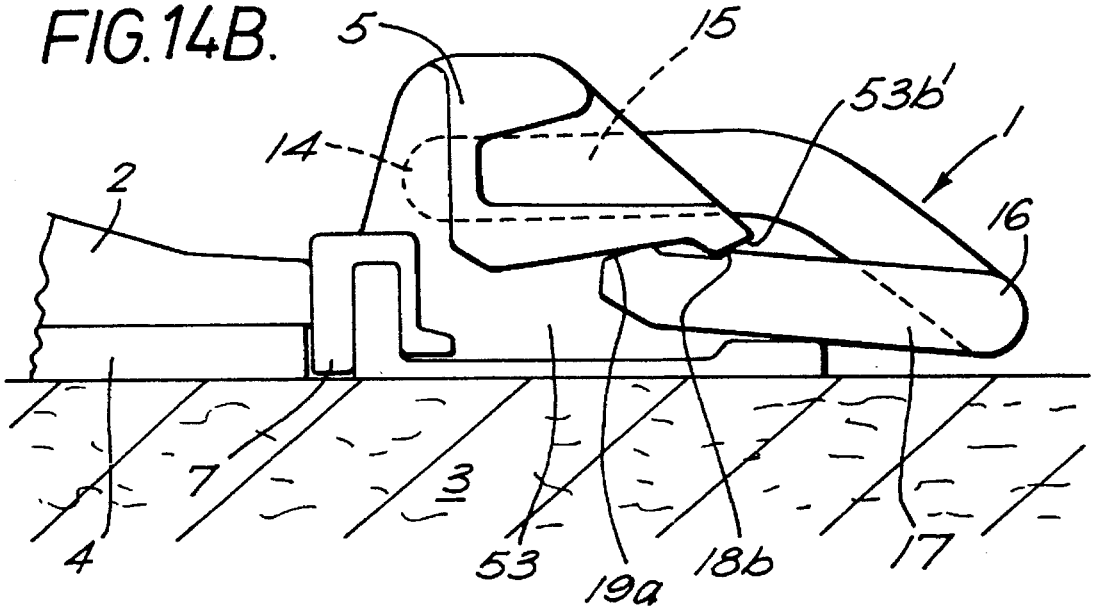

When the clip is driven into an intermediate position, as shown in FIG. 14B, in which the face of the detent 18*b* is brought into contact with the first face 53*b*' of the projection 53*b*, the outer legs are deflected downwardly a little more, bringing the second and sixth portions 12 and 16 of the clip 1 upwardly. In this position, the fourth portion of the clip rests above part of the side post insulator 7, thereby preventing upward movement of that insulator. If the insulator is shaped such that it holds down the rail pad 4, then in this position the clip also serves to retain the rail pad through the insulator. Thus, it is envisaged that the clip, insulator, and preferably also the pad, could be installed on a sleeper provided with an anchoring device 5 in the sleeper factory before being taken to site.

Figure 14C:
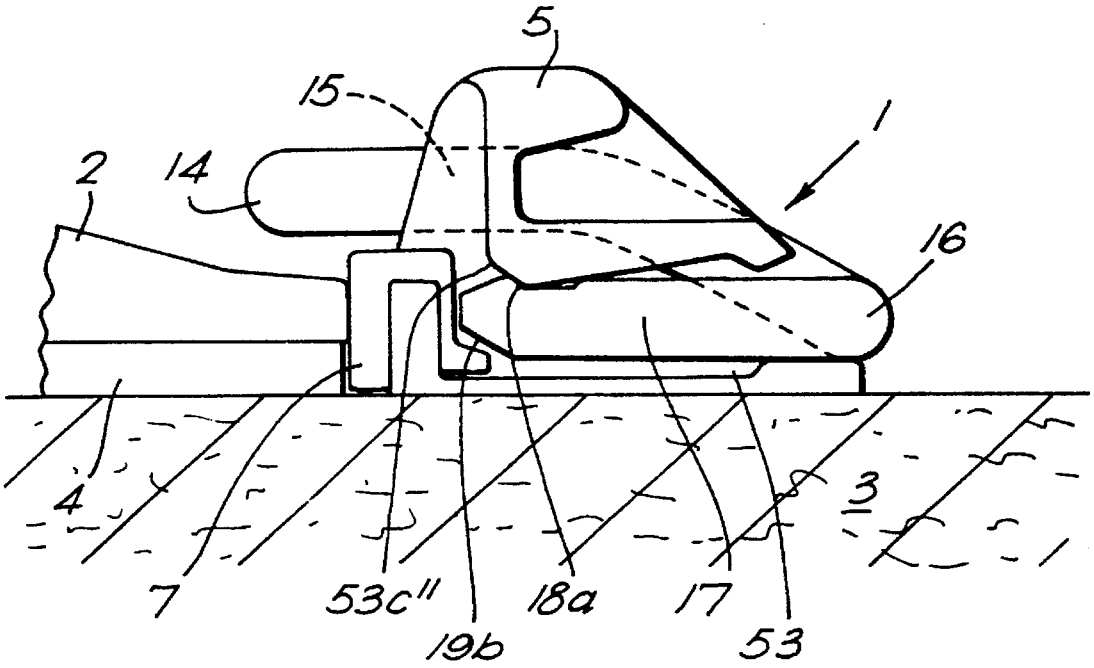

FIG. 14C shows the clip as it appears when it has been driven from the intermediate position shown in FIG. 14B into a final position where the fourth portion 14 (normally carrying a toe insulator 6) of the clip 1 bears on the rail 2. As the clip is driven horizontally, the sloping roof of the passageway in contact with the upper tapered surface 19*a* of the outer leg urges the outer leg downwardly, thereby deflecting the clip. In the final position of the clip, the detent 18 in the clip 1 is engaged by the second projection 53*c* of the anchoring device 5 and the free ends of the outer legs overlie the locating feet 76 of the side post insulator 7 so that upward movement of the insulator 7 is further restricted. The clip is fully deflected in this position, the fourth portion of the clip lying in a plane which is substantially parallel to the plane containing the first and seventh portions of the clip and the second and sixth portions 12 and 16 of the clip being at their highest point.

When the clip is in its initial position, the insulator is free to move upwardly, so, if replacement of the insulator 7 is required, this may be achieved by driving the clip 1 back into its initial position, without the need to remove the clip 1 completely from the anchoring device 5.

As the second and sixth portions 12 and 16 of the clip are, in the initial position of the clip, close to the surface of the sleeper, a potential problem of rail foot entrapment, that could occur when a rail is being lifted from its typical initial position alongside the rear of the anchoring device onto the rail pad 4, can be avoided. This shape of clip, in which the outer legs are deflected downwardly in relation to the inner legs, also allows the overall height of the shoulder to be reduced, thereby permitting it to be lighter and cheaper. Desirably, when a clip 1 is installed in an anchoring device 5 there is a clearance of about 5 mm between the bottom of the toe insulator 6 and the base member 51 of the anchoring device 5 so as to ensure that if the height of the rail is reduced owing to wear of the rail pad beneath it the clip will not be prevented from bearing sufficiently on the rail by the base member 51 of the anchoring device 5.

We claim:

1. A railway rail fastening clip comprising a rod of resilient material bent to be approximately M-shaped, the clip having a first substantially straight outer limb (11) opposite to a second substantially straight outer limb (17) and a first substantially straight inner limb (13) opposite to a second substantially straight inner limb (15), wherein each said inner limb is contiguous with a bent toe portion (14), and the first outer limb (11) is contiguous with the first inner limb (13) by means of a first bent portion (12), and the second outer limb (17) is contiguous with the second inner limb (15) by means of a second bent portion (16) such that when the clip is in a position such that the clip can be inserted into an anchoring device and when the clip is in an unstressed configuration, a longitudinal axis of the toe portion (14) lies in a plane angled above a plane having a longitudinal axis of the outer limbs (11, 17), but when the clip is in a stressed operative configuration, the longitudinal axis of the toe portion (14) lies in a plane that is substantially parallel to the plane having the longitudinal axis of the outer limbs (11, 17).

2. The clip of claim 1, wherein the first inner limb (13) and the second inner limb (15) are inclined toward each other at a location spaced from and distal to the toe.

3. The clip of claim 1, wherein a longitudinal axis of the first bent portion (12) and the second bent portion (16) is inclined to the plane of the first straight outer limb (11) and the second straight outer limb (17) in the unstressed configuration at an angle of up to 40 degrees.

4. The clip of claim 1, wherein a longitudinal axis of each said first (12) and said second (16) bent portion is inclined to the plane of the first (11) and the second (17) straight outer limbs in the unstressed configuration at an angle of not greater than about 33 degrees.

5. The clip of claim 1, wherein the clip, in the unstressed configuration, has a ratio of a maximum distance between the longitudinal axis of each said inner limb (13, 15) and the plane containing the longitudinal axis of each said outer limb (11, 17) to a diameter of the rod equal to 4.

6. The clip of claim 1, wherein the clip, in the unstressed configuration, has a ratio of a maximum distance between the longitudinal axis of each said inner limb (13, 15) and the plane containing the longitudinal axis of each said outer limb (11, 17) to a diameter of the rod equal to 2.0.

7. The clip of claim 1, wherein the clip, in the unstressed configuration, has a ratio of a maximum distance between the longitudinal axis of each said inner limb (13, 15) and the plane containing the longitudinal axis of each said outer limb (11, 17) to a diameter of the rod equal to 1.25.

8. The clip of claim 1, wherein the toe portion (14) extends beyond a first end (A) of the first outer limb (11) and a second end (B) of the second outer limb (17) of the clip.

9. The clip of claim 1, wherein each said outer limb (11, 17) has a tapered upper surface (19*a*) to facilitate insertion of the clip into an anchoring device.

10. The clip of claim 9, wherein each said tapered upper surface (19*a*) is tapered at an angle of about 30 degrees.

11. The clip of claim 4, wherein at least one of the inner limbs (13, 15) or at least one of the outer limbs (11, 17) has a locating means (18) for positioning the clip in an anchoring device such that the toe portion (14) of the clip rests on a rail flange.

12. The clip of claim 11, wherein the locating means is a detent (18).

13. The clip of claim 12, wherein each said outer limb (11, 17) of the clip has the detent (18).

14. An assembly for fastening a railway rail to an underlying rail sleeper comprising a railway rail fastening clip (1) and an anchoring device (5) adjacent to the rail and secured to the sleeper (3) for retaining the clip, wherein the clip comprises a rod of resilient material bent to be approximately M-shaped, the clip having a first substantially straight outer limb (11) opposite to a second substantially straight outer limb (17), and a first substantially straight inner limb (13) opposite to a second substantially straight inner limb (15), wherein each said inner limb is contiguous with a bent toe portion (14), and the first outer limb (11) is contiguous with the first inner limb (13) by means of a first bent portion (12) and the second outer limb (17) is contiguous with the second inner limb (15) by means of a second bent portion (16) such that when the clip is in a position such that the clip can be inserted into the anchoring device and when the clip is in an unstressed configuration, a longitudinal axis of the toe portion (14) lies in a plane angled above a plane having longitudinal axes of the outer limbs (11, 17), but when the clip is in a stressed operative configuration, the longitudinal axis of the toe portion (14) lies in a plane that is substantially parallel to the plane having the longitudinal axes of the outer limbs (11, 17); the anchoring device (5) comprises a base member (51) and a pair of clip-retaining members (52) connected to respective opposite ends of the base member (51), wherein each of said clip-retaining members has a wall (52*a*) vertical to the base (51), the clip-retaining members (52) being spaced apart to define an opening (54) for receiving the toe portion (14) and the inner limbs (13, 15) of the clip; the anchoring device (5) further comprising a passageway (53) on respective outer faces of each said vertical wall (52*a*) for receiving the outer limbs (11, 17) of the clip such that the outer limbs (11, 17) of the clip are forced downward from the inner limbs (13, 15) and the toe portion (14) of the clip projects from the opening (54) of the device to bear on a rail flange.

15. The assembly of claim 14, wherein the clip-retaining members have an inwardly-projecting portion (55) extending at least partially over the opening (54) such that the inwardly-projecting portions limit upward movement of the inner limbs (13, 15) of the clip.

16. The assembly of claim 15, wherein the clip further comprises a locating means (18) on an upper surface of the first straight outer limb (11) and a second locating means (18) on an upper surface of the second straight outer limb (17), the passageway (53) comprising a roof (53*a*, 53*b*, 53*c*) having a sloping part (53*a*) for abutting each said outer limb (11, 17) of the clip to drive each said outer limb of the clip in a downward direction from each said inner limb (13, 15), wherein each said sloping part (53*a*) slopes downwardly in a direction toward the base (51) of the device (5); the roof further comprising a first locating means projection (53*b*) contiguous with the sloping part (53*a*) and distal to the base (51) and a second locating means projection (53*c*) contiguous with the sloping part (53*a*) and proximal to the base (51) of the device (5) for engaging the locating means (18) of each said outer limb (11, 17) of the clip.

17. The assembly of claim 16, wherein each said second locating means projection (53*c*) engages each said locating means (18) on each said outer limb (13, 17) of the clip when the clip is inserted into the device (5) such that the toe portion (14) bears on the rail flange.

18. The assembly of claim 16, wherein each said first locating means projection (53*b*) engages each said locating means (18) on each said outer limb (13, 17) of the clip when the clip is inserted into the device (5) and the toe portion (14) does not bear on a rail flange.

19. The assembly of claim 18, wherein the locating means is a detent (18).

20. The assembly of claim 14, further comprising a step (51*a*) contiguous with the base (51).

21. The assembly of claim 20, further comprising a shoulder insulator (7) composed of an electrically-insulating material for electrically isolating the anchoring device (5) from the rail (2), the insulator (7) having a first and a second contiguous plate (71, 72), wherein the first plate (71) is perpendicular to the second plate (72) such that the second plate (72) of the insulator (7) rests on the step (51*a*) of the anchoring device, and the first plate (71) of the insulator rests between the rail (2) and the anchoring device (5), the insulator further comprising a pair of insulator locating means (73) contiguous with, but at opposite ends of the first plate, each said insulator locating means (73) having a locating foot (76) parallel to the first plate and perpendicular to the second plate (72) such that each of said outer limbs (11, 17) of the clip rests on each said corresponding foot (76) when the clip is inserted into the anchoring device.

22. The assembly of claim 14, further comprising a clip insulator (6) to electrically isolate the clip from the rail, the clip insulator comprising a body (60) with a channel (61) for the toe portion (14) and each said inner limb (13, 15) of the clip to rest.

23. The assembly of claim 22, wherein the clip insulator (6) comprises resilient projections (62) at opposite ends of the channel and over hanging the channel, wherein the projections deform under pressure to allow the insulator (6) to be clipped onto or removed from the clip.

24. The assembly of claim 23, wherein the projections (62) comprise edges (62*a*) that are chamfered.

25. The assembly of claim 14, further comprising a clip insulator to electrically isolate the clip from the rail, the clip insulator comprising an encapsulating pocket (600) wherein the toe portion (14) of the clip is retained.

26. A method of installing a railway rail fastening clip into an anchoring device, wherein the clip (1) comprises a rod of resilient material bent to be approximately M-shaped, the clip having a first substantially straight outer limb (11) opposite to a second substantially straight outer limb (17), and a first substantially straight inner limb (13) opposite to a second substantially straight inner limb (15), wherein each said inner limb is contiguous with a bent toe portion (14), and the first outer limb (11) is contiguous with the first inner limb (13) by means of a first bent portion (12) and the second outer limb (17) is contiguous with the second inner limb (15) by means of a second bent portion (16) such that when the clip is in a position such that the clip can be inserted into the anchoring device and when the clip is in an unstressed configuration, a longitudinal axis of the toe portion (14) lies in a plane angled above a plane having longitudinal axes of the outer limbs (11, 17), but when the clip is in a stressed operative configuration, the longitudinal axis of the toe portion (14) lies in a plane which is parallel to the plane having the longitudinal axes of the outer limbs (11, 17), the clip further comprising a locating means (18) on each said outer limb to position the clip in the anchoring device; the anchoring device (5) comprises a base member (51) and a pair of clip-retaining members (52) connected to respective opposite ends of the base member (51), wherein each of said clip-retaining members has a wall (52*a*) vertical to the base (51), the clip-retaining members (52) being spaced apart to define an opening (54) for receiving the inner limbs (13, 15) and the toe portion (14) of the clip; the anchoring device (5) further comprising a passageway (53) on respective outer faces of the each said vertical wall (52*a*), wherein each said passageway has a roof (53*a*, 53*b*, 53*c*) comprising a sloping part (53*a*) with a first projection (53*b*) distal to the base (51) and a second projection (53*c*) proximal to the base (51); the method comprising inserting the toe portion (14) and each said inner limb (13, 15) through the opening (54) and inserting each said outer limb (11, 17) into each said respective passageway (53) such that the detent (18) of each said outer limb (11, 17) cooperates with the respective first projection (53*b*) of the roof (53*a*, 53*b*, 53*c*) of each said passageway, and driving the clip such that each of said outer limbs (11, 17) are forced downwardly along the sloping part (53*a*) of the roof of each of said passageway (53) and away from the inner limbs (13, 15) until the locating means (18) of each said outer limb (11, 17) cooperates with the second projection (53*c*) of each said roof, and the toe portion (14) extends beyond the base (51) to bear on a rail.

27. The method of claim 26, wherein the locating means (18) is a detent.

* * * * *